US006666723B2

(12) United States Patent
Fukumori et al.

(10) Patent No.: US 6,666,723 B2
(45) Date of Patent: Dec. 23, 2003

(54) MULTIPLE-FUSE HOLDER

(75) Inventors: Shuichi Fukumori, Brussels (BE); Van Dessel Sonny, Haacht (BE)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/080,154

(22) Filed: Feb. 19, 2002

(65) Prior Publication Data

US 2002/0115349 A1 Aug. 22, 2002

(30) Foreign Application Priority Data

Feb. 22, 2001 (JP) ..... 2001-047355

(51) Int. Cl.[7] ..... H01R 13/68
(52) U.S. Cl. ..... 439/621; 439/590; 439/937
(58) Field of Search ..... 439/621, 590, 439/594, 937, 622, 250, 366, 698, 830, 890, 949

(56) References Cited

U.S. PATENT DOCUMENTS

| | | | | |
|---|---|---|---|---|
| 3,378,808 A | | 4/1968 | French | |
| 3,848,951 A | | 11/1974 | Michaels et al. | |
| 4,094,564 A | * | 6/1978 | Cacolici | 439/456 |
| 4,184,733 A | | 1/1980 | Schmeling | |
| 4,230,387 A | * | 10/1980 | Zahn | 439/590 |
| 4,391,482 A | | 7/1983 | Czeschka | |
| 4,466,683 A | * | 8/1984 | Ballarini | 439/571 |
| 4,560,227 A | * | 12/1985 | Bukala | 439/557 |
| 4,943,248 A | | 7/1990 | Colleran et al. | |
| 4,944,684 A | * | 7/1990 | Leibowitz | 439/76 |
| 5,194,018 A | * | 3/1993 | Lopata et al. | 439/540 |
| 5,281,171 A | * | 1/1994 | Job | 439/621 |
| 5,409,399 A | | 4/1995 | Geoghegan et al. | |
| 5,552,951 A | | 9/1996 | Pasch et al. | |
| 5,632,654 A | | 5/1997 | Sugiura | |
| 5,752,856 A | * | 5/1998 | Boutin et al. | 439/621 |
| 5,785,537 A | | 7/1998 | Donahue et al. | |
| 5,926,952 A | * | 7/1999 | Ito | 29/883 |
| 6,089,918 A | | 7/2000 | Arakelian et al. | |
| 6,280,253 B1 | | 8/2001 | Kraus et al. | |
| D461,781 S | | 8/2002 | Fukumori et al. | |
| D462,061 S | | 8/2002 | Fukumori et al. | |
| 6,482,050 B1 | | 11/2002 | Lemke et al. | |
| 6,533,614 B1 | | 3/2003 | Akama et al. | |

FOREIGN PATENT DOCUMENTS

| | | |
|---|---|---|
| JP | 05342979 | 12/1993 |
| JP | 06150806 | 5/1994 |
| JP | 06231672 | 8/1994 |
| JP | 09245611 | 9/1997 |
| WO | DM/054992 | 3/2001 |

OTHER PUBLICATIONS

"Fuse Holder", by Shuichi Fukumori et al., U. S. patent application 10/080,149; Feb. 19, 2002, pp. 1 to 21 and 23 sheets of drawings.
"Fuse Holder", by Shuichi Fukumori et al., U. S. patent application 10/080,151; Feb. 19, 2002, pp. 1 to 23 and 28 sheets of drawings.

* cited by examiner

*Primary Examiner*—Ross Gushi
(74) *Attorney, Agent, or Firm*—W. F. Fasse; W. G. Fasse

(57) ABSTRACT

A multiple-fuse holder includes a holder housing group of plural holder housings arranged at a constant pitch, with each pair of adjacent holder housings coupled together by coupling parts. In each holder housing, a chamber for holding the blade terminals and at least a part of the body of a fuse is formed with wide walls at the front and the rear and narrow walls on the right and the left. Two respective contacts are provided for each holder housing. Each contact has an intermediate part fixed to the holder housing, a connecting part, at one end, extending into the chamber to fit with a blade terminal, and a leg, at the other end, extending out of the holder housing to be soldered or otherwise connected onto a printed circuit board.

22 Claims, 34 Drawing Sheets

MULTIPLE-FUSE HOLDER

CROSS-REFERENCE TO RELATED APPLICATIONS

This application is related to our copending U.S. patent application Ser. Nos. 10/080,149 and 10/080,151, both filed on Feb. 19, 2002.

BACKGROUND OF THE INVENTION

1. Field of the Invention

The present invention belongs to a field of fuse holder into which a blade type fuse, with blade terminals protruding from its body, is fitted.

2. Related Art

A fuse fitting device into which a blade type fuse is fitted is known. This device comprises a block of synthetic resin, and connecting terminals, which are inserted from below into a chamber in the block and fitted to a lance of the block. When this fuse fitting device is to be used, electric wires are connected to the connecting terminals, these connecting terminals are inserted into the chamber of the block and fitted to the lance, a fuse is inserted from above into the chamber of the block, and the blade terminals of the fuse are fitted into the connecting terminals to make connection (for example, refer to Japanese Patent unexamined publication gazette Heisei 6-150806).

When a plurality of fuses are to be fitted into this fuse fitting device, a block must be newly designed whenever the number of fuses to be used is modified. It is inevitable to produce a mold for the block in each occasion, and in turn, the production of the fuse fitting device is costly.

SUMMARY OF THE INVENTION

The present invention was made in view of these points, and one objective of the invention is to propose a multiple-fuse holder, wherein a plurality of fuse holders, each of which is a combination of a holder housing and contacts, are coupled together, use the multiple-fuse holder, mount a required number of fuse holders on a printed circuit board, load the printed circuit board in a casing or the like and produce a fuse fitting device, and easily produce a fuse fitting device for any number of fuses to be used and reduce the production cost of the fuse fitting device. Other objectives include to reduce the production cost by adopting fork-shaped contacts, and to guarantee high performance of the fuse fitting device by supporting these contacts by the holder housing and preventing the contacts from being pried.

To accomplish these objectives, the present invention is a multiple-fuse holder into which a plurality of blade type fuses, with blade terminals protruding from the bodies thereof, are fitted, said multiple-fuse holder comprises a holder housing group wherein a plurality of holder housings, in each of which a chamber for holding the blade terminals and at least a part of the body of a fuse inserted from above is formed with wide walls at the front and the rear and narrow walls on the right and the left, are arranged at a constant pitch and each pair of adjacent holder housings are coupled together by coupling parts, each of which is integrally formed on a part of a wall thereof, and contacts, which are provided two for each holder housing, each contact having an intermediate part fixed to the holder housing, a connecting part, at one end, extending into the chamber to fit with a blade terminal, and a leg, at the other end, extending out of the holder housing to be soldered or press-fitted onto a printed circuit board.

When a fuse is fitted into each holder housing of this multiple-fuse holder, the blade terminals and at least a part of the body of each fuse will be held in the chamber of each holder housing, and the blade terminals will be fitted into the connecting parts of the contacts. A multiple-fuse holder or a plurality of multiple-fuse holders is arranged on a printed circuit board. Or a fuse holder or a plurality of fuse holders, which is obtained by dividing a multiple-fuse holder, is arranged on a printed circuit board. When the leg of each contact is soldered or press-fitted onto the printed circuit board, the required number of fuse holder (single or plural) will be mounted onto the printed circuit board. When conductive parts such as electric wires are connected to the pattern of the printed circuit board, the fuse or fuses will be electrically connected to the conductive parts. When the printed circuit board is loaded into a casing or the like, a fuse fitting device will be produced. When this multiple-fuse holder is used, a fuse fitting device can be made with ease for any number of fuses to be used without newly designing a block. Hence the production cost is reduced. To produce a fuse fitting device, a multiple-fuse holder or a plurality of multiple-fuse holders or a fuse holder or a plurality of fuse holders may be mounted onto the printed circuit board before fitting a fuse into each fuse holder.

Accordingly, a fuse fitting device can be produced easily for any number of fuses to be used by properly dividing the multiple-fuse holder of the present invention or keeping it intact, mounting the fuse holders onto a printed circuit board and loading the printed circuit board in a casing or the like, and in turn, the production cost of the fuse fitting device can be reduced.

DESCRIPTION OF PREFERRED EMBODIMENTS OF THE INVENTION

Figure 13:
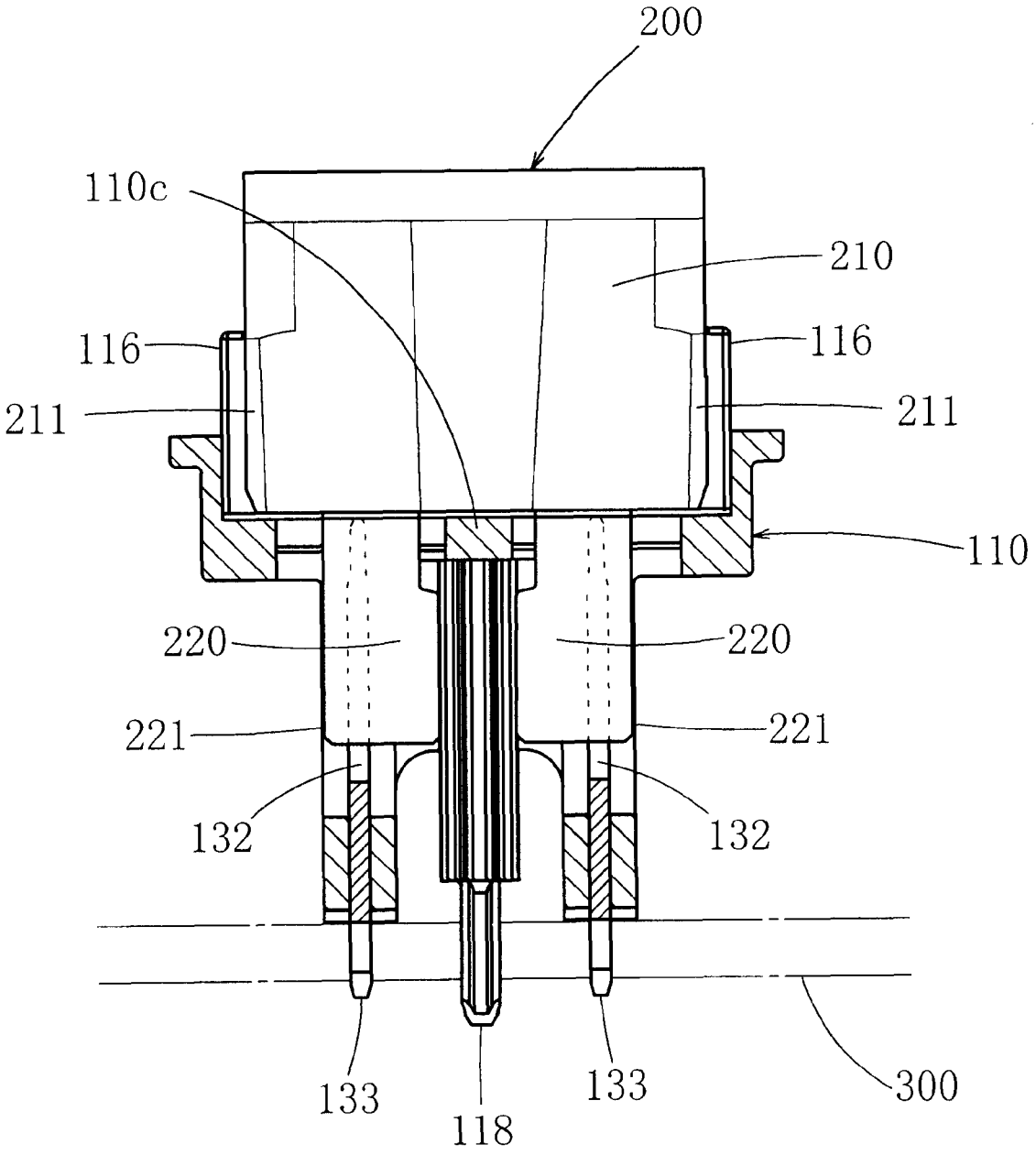
FIG. 13 is a sectional view of a fuse holder divided from the first embodiment of the multiple-fuse holder. A fuse is fitted into the fuse holder and the fuse holder is cut in both the left wall and the right wall.
Figure 14:
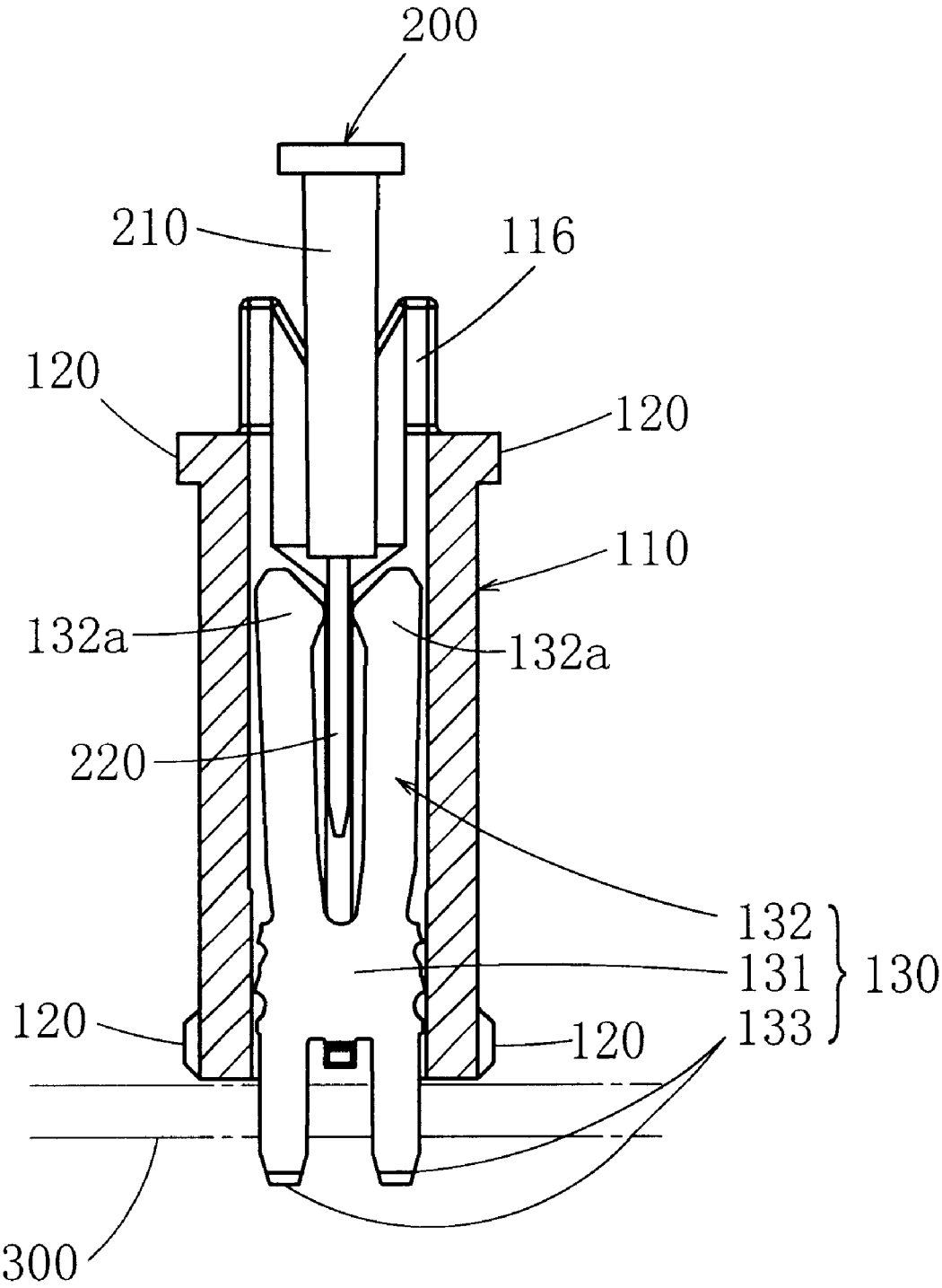
FIG. 14 is a sectional view of the fuse holder divided from the first embodiment of the multiple-fuse holder. A fuse is fitted into the fuse holder and the fuse holder is cut in both the front wall and the rear wall.
Figure 15:
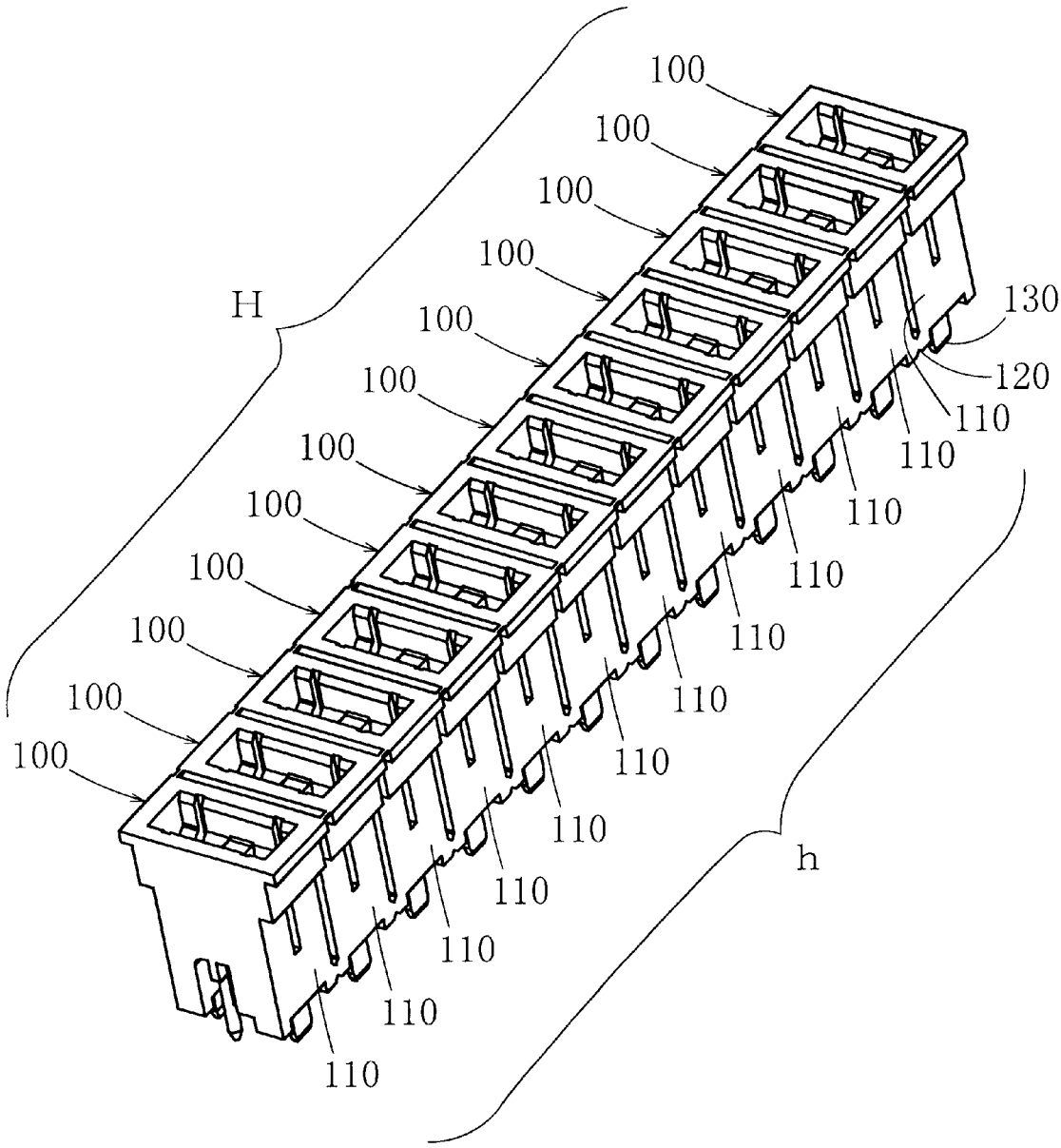
FIG. 15 is a perspective view of the second embodiment of the multiple-fuse holder according to the present invention. The multiple-fuse holder is seen from the top thereof.
Figure 16:
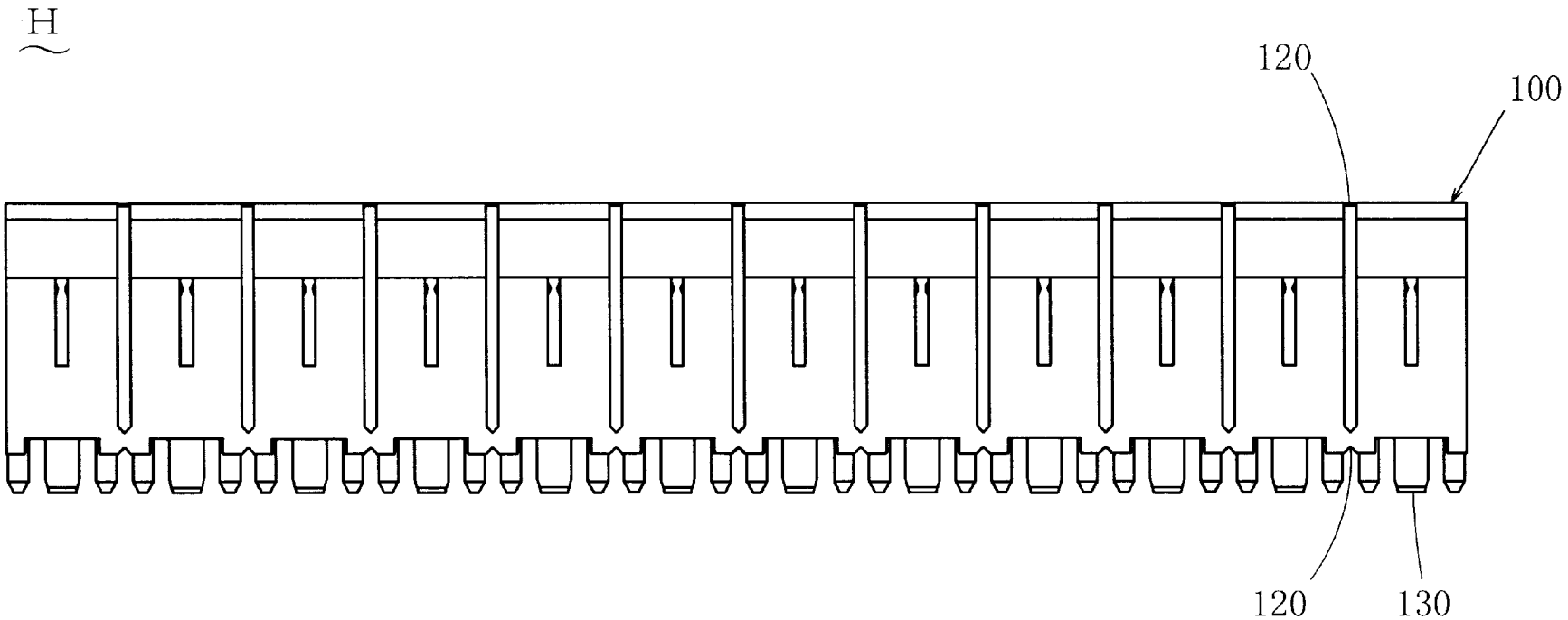
FIG. 16 is a side view of the second embodiment of the multiple-fuse holder.
Figure 17:
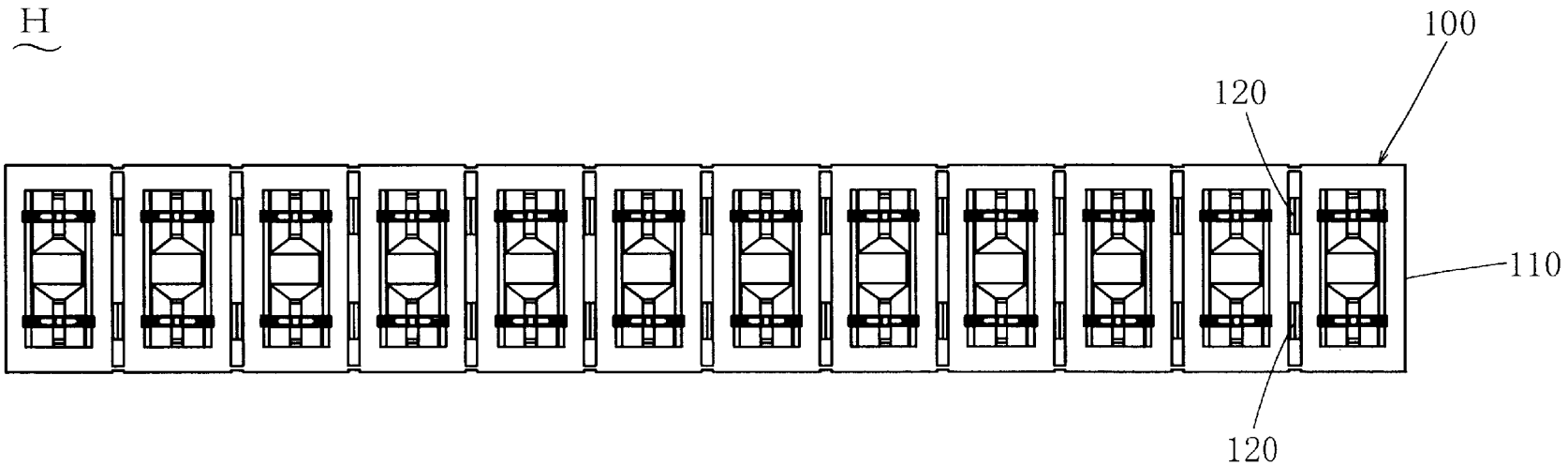
FIG. 17 is a plan view of the second embodiment of the multiple-fuse holder.
Figure 18:
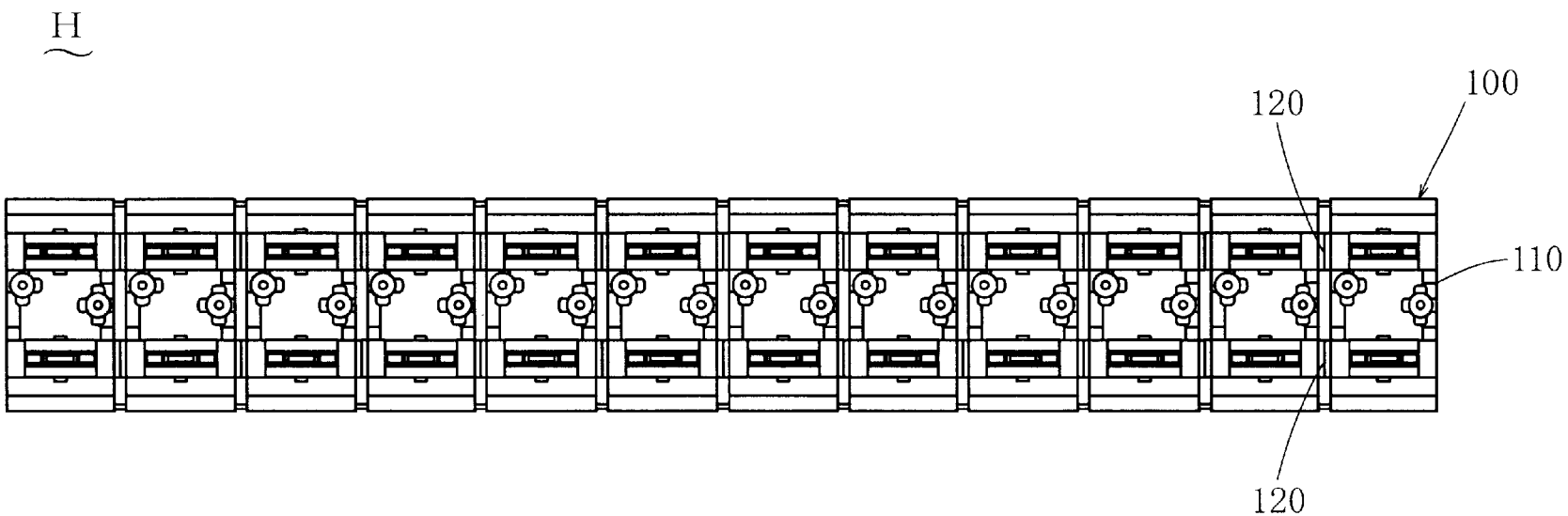
FIG. 18 is a bottom view of the second embodiment of the multiple-fuse holder.
Figure 19:
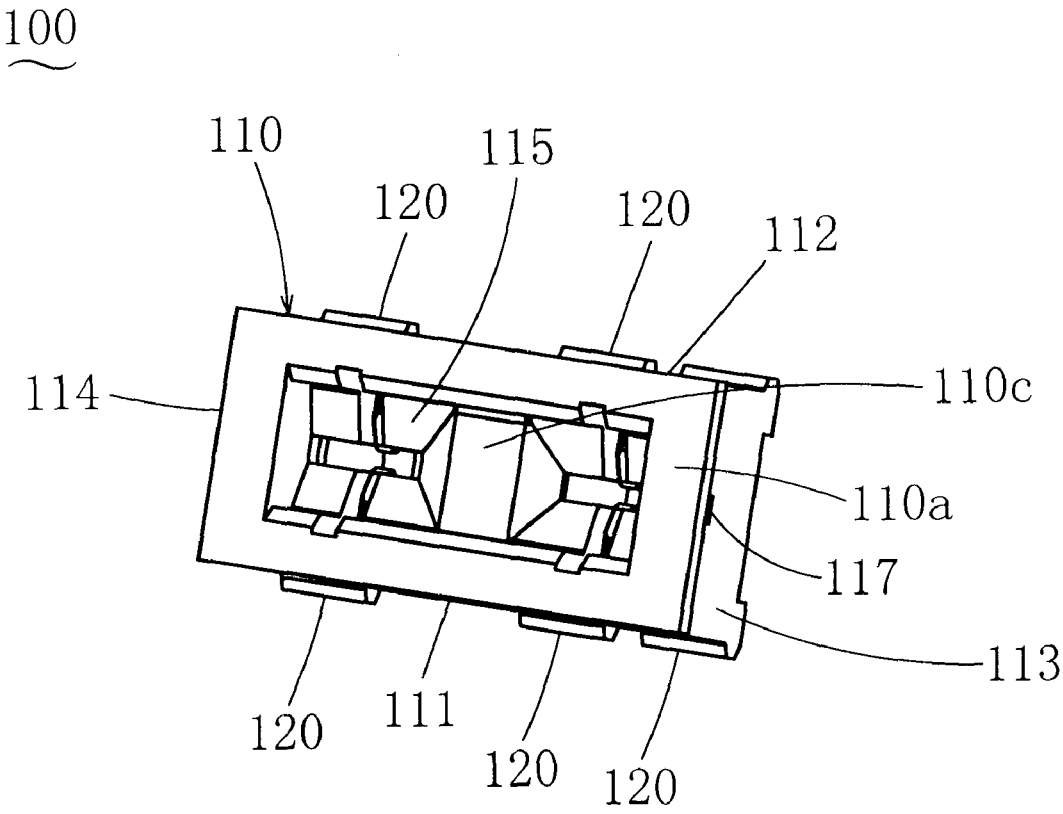
FIG. 19 is a perspective view of a fuse holder divided from the second embodiment of the multiple-fuse holder. The fuse holder is seen from the top.
Figure 20:
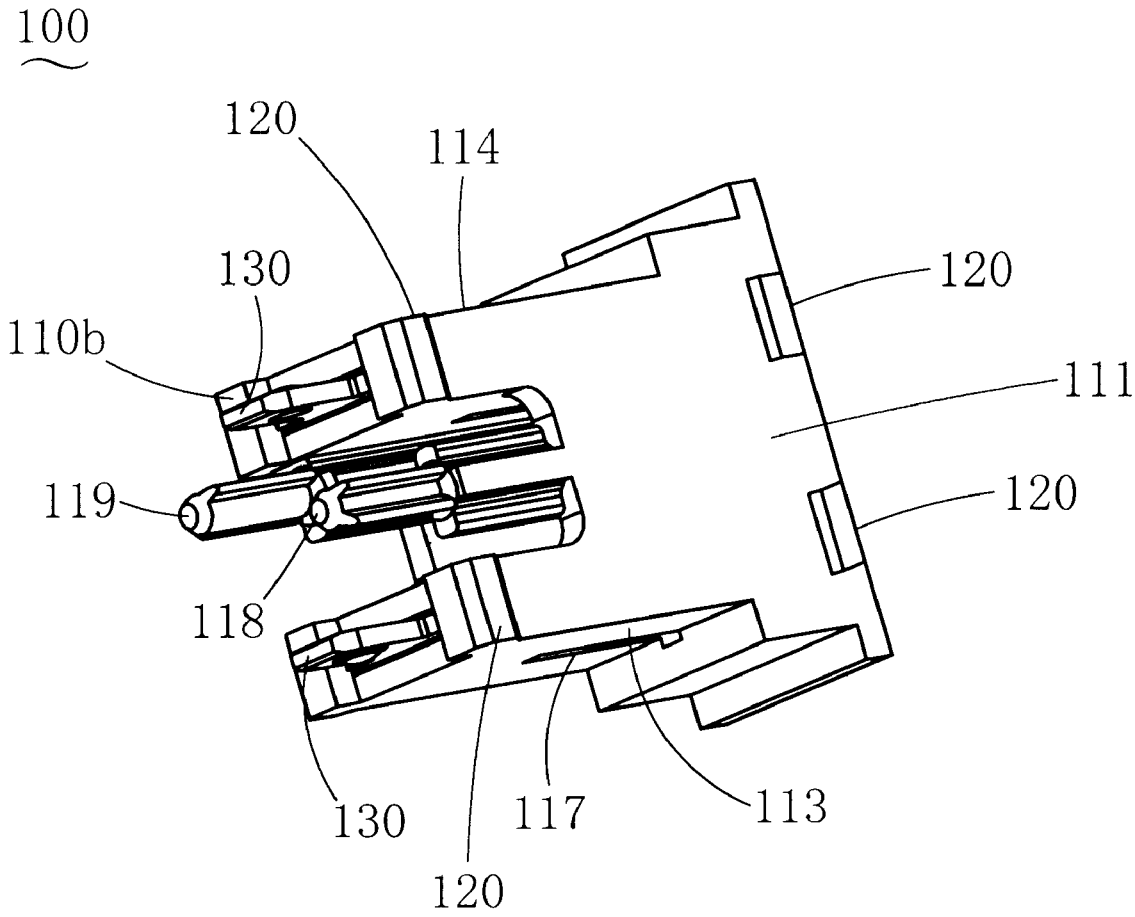
FIG. 20 is a perspective view of the fuse holder divided from the second embodiment of the multiple-fuse holder. The fuse holder is seen from the bottom.
Figure 21:
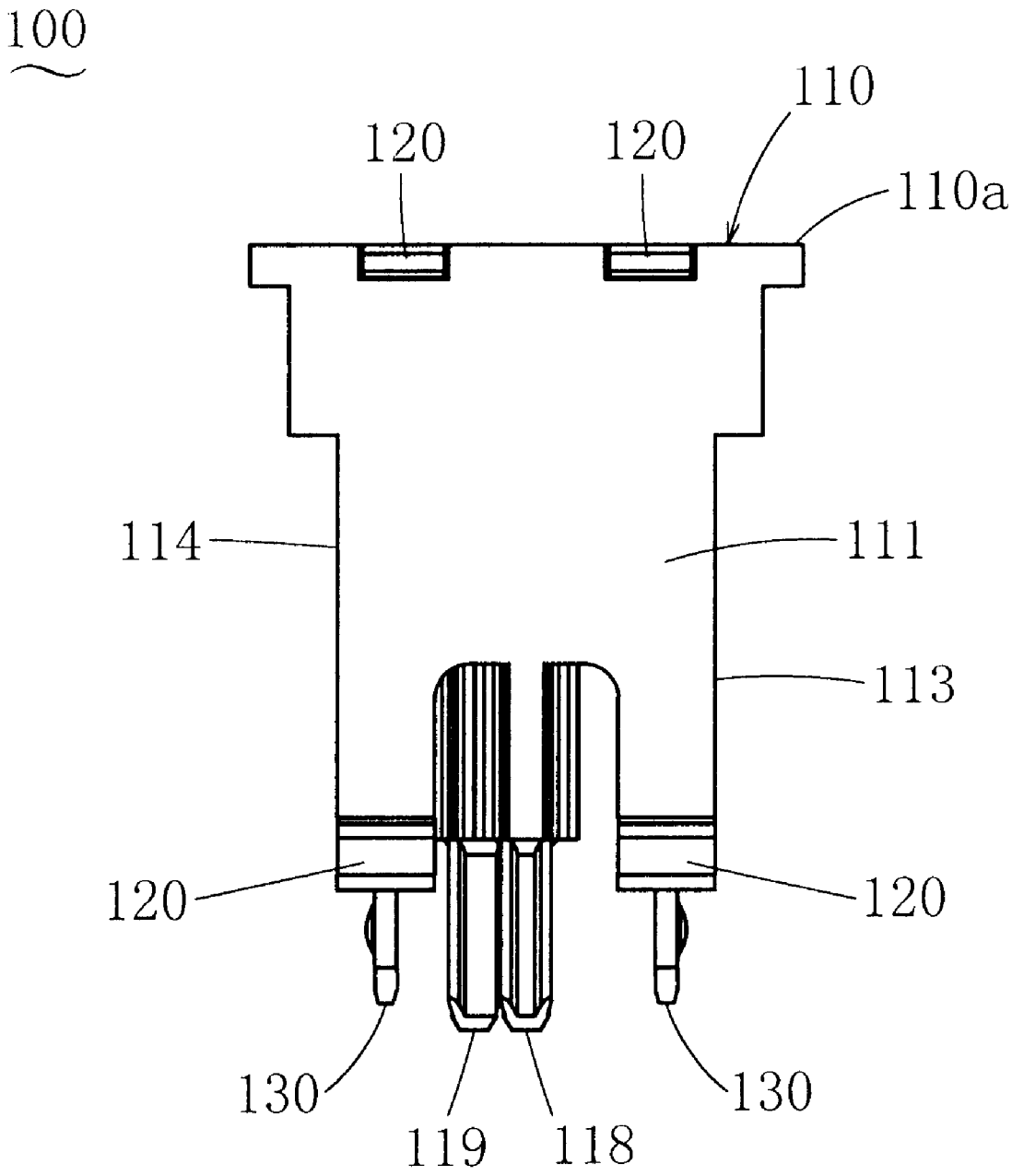
FIG. 21 is a front view of the fuse holder divided from the second embodiment of the multiple-fuse holder.
Figure 22:
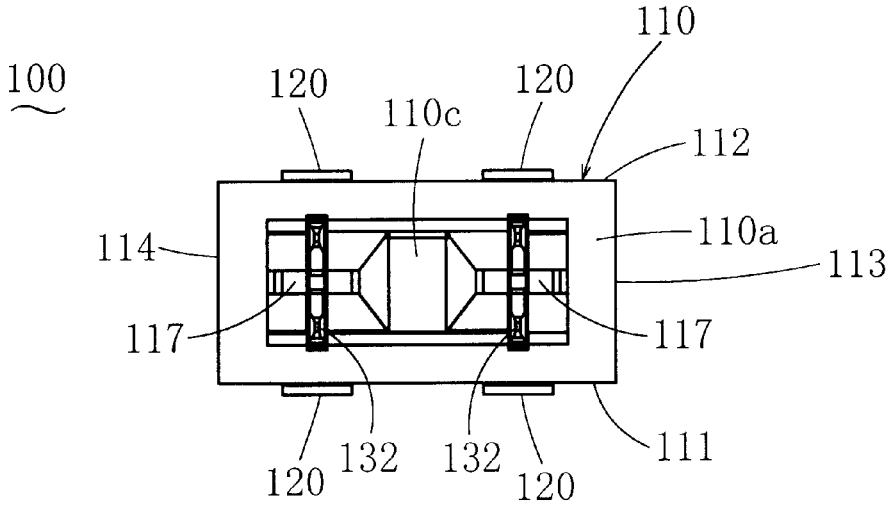
FIG. 22 is a plan view of the fuse holder divided from the second embodiment of the multiple-fuse holder.
Figure 23:
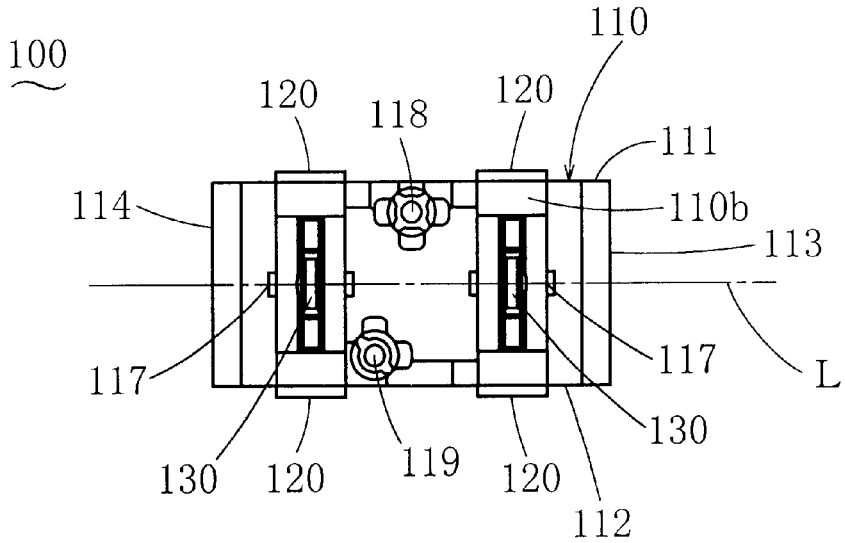
FIG. 23 is a bottom view of the fuse holder divided from the second embodiment of the multiple-fuse holder.
Figure 24:
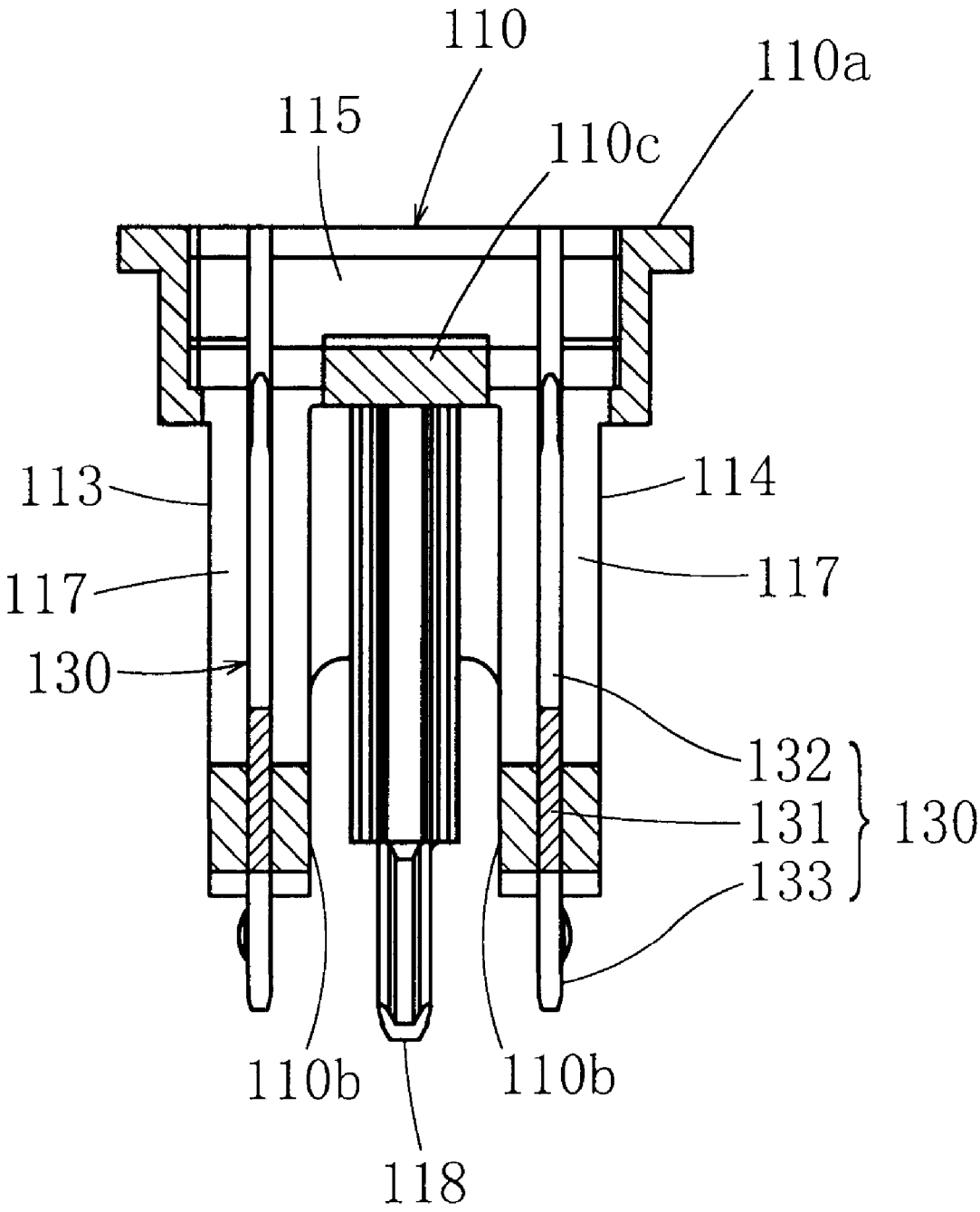
FIG. 24 is a sectional view of the fuse holder divided from the second embodiment of the multiple-fuse holder. The fuse holder is cut in both the left wall and the right wall thereof.
Figure 25:
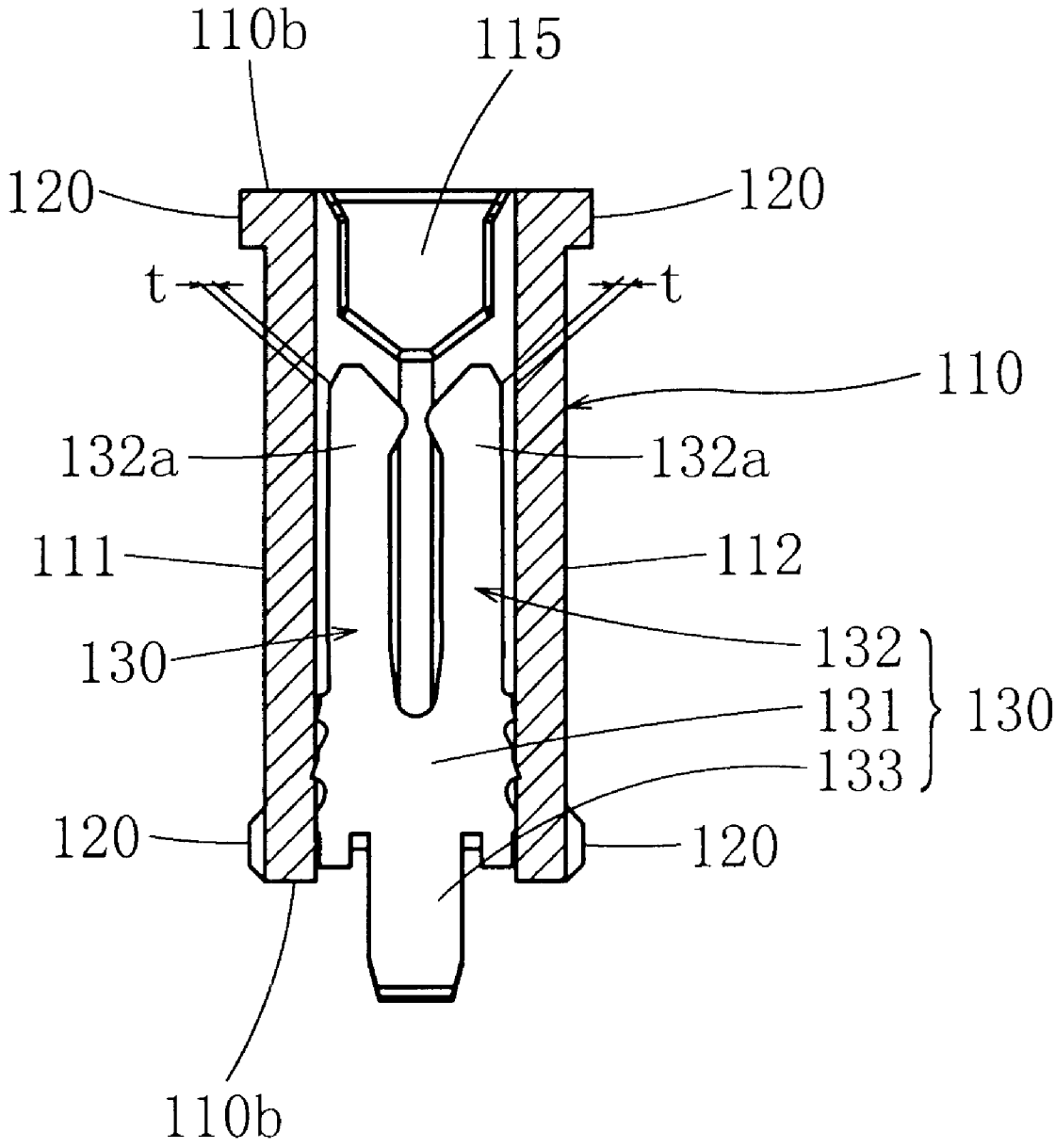
FIG. 25 is a sectional view of the fuse holder divided from the second embodiment of the multiple-fuse holder. The fuse holder is cut in both the front wall and the rear wall thereof.
Figure 26:
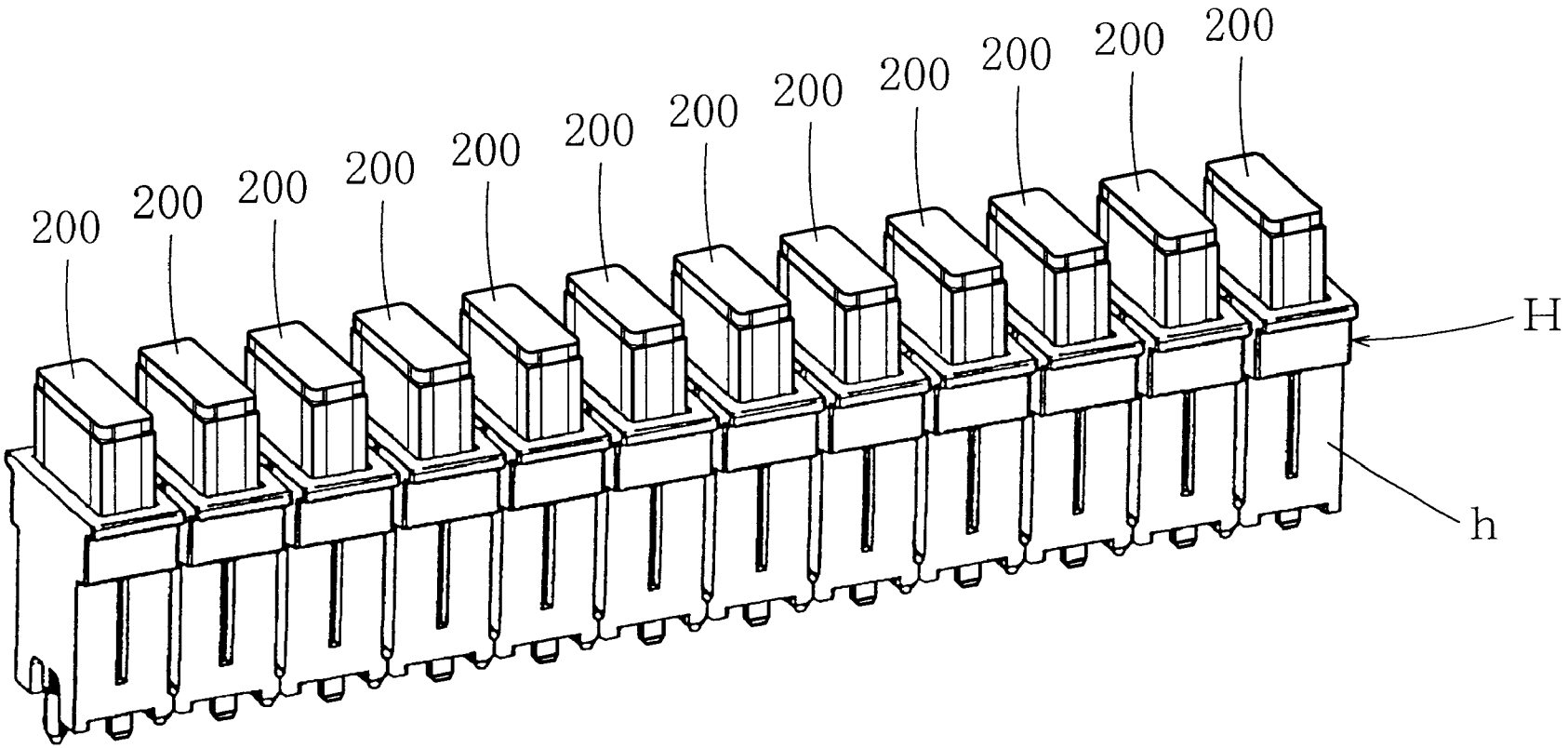
FIG. 26 is a perspective view of the second embodiment of the multiple-fuse holder with the fuses being fitted. The multiple-fuse holder is seen from the top.
Figure 27:
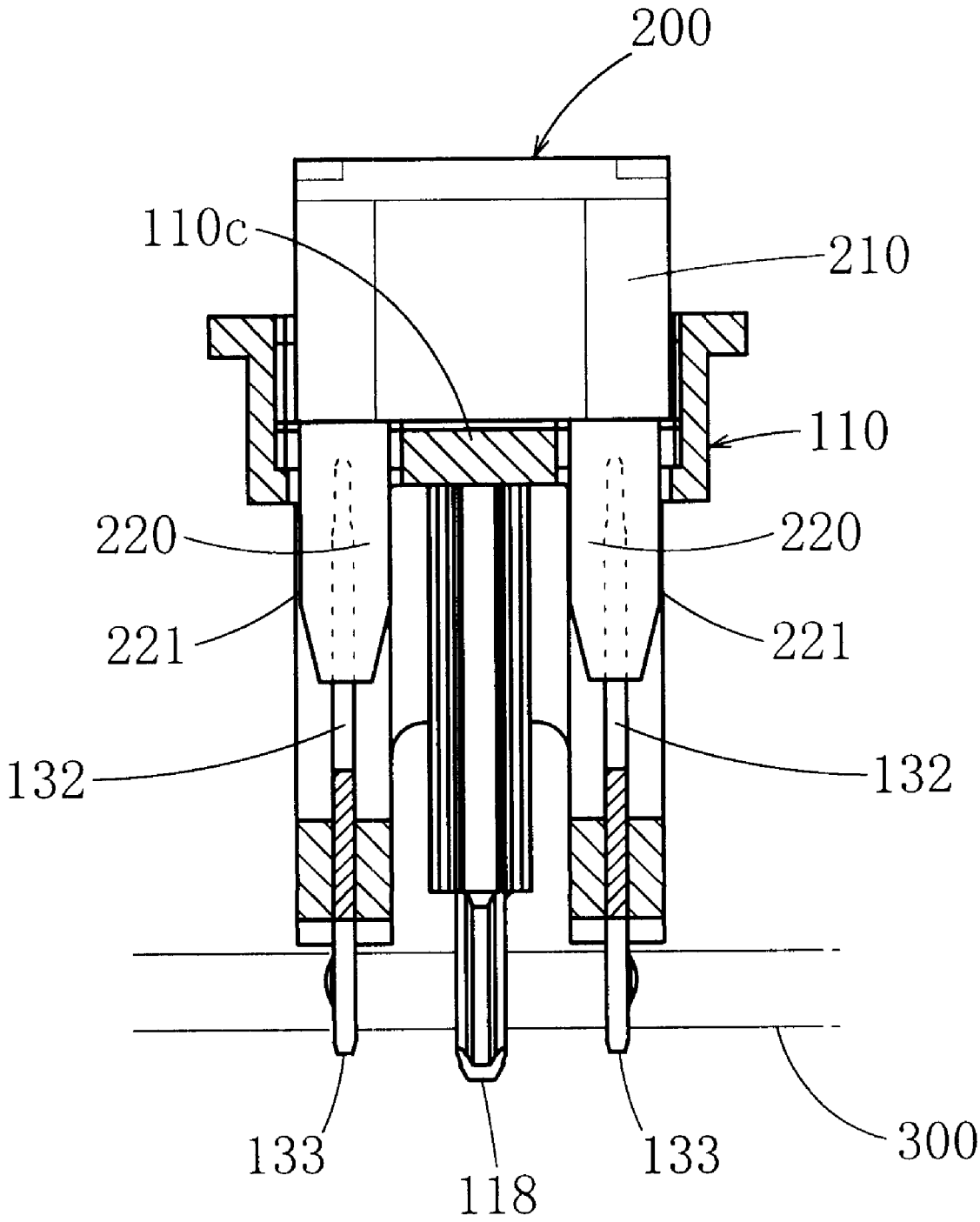
FIG. 27 is a sectional view of a fuse holder divided from the second embodiment of the multiple-fuse holder. A fuse is fitted into the fuse holder and the fuse holder is cut in both the left wall and the right wall.
Figure 28:
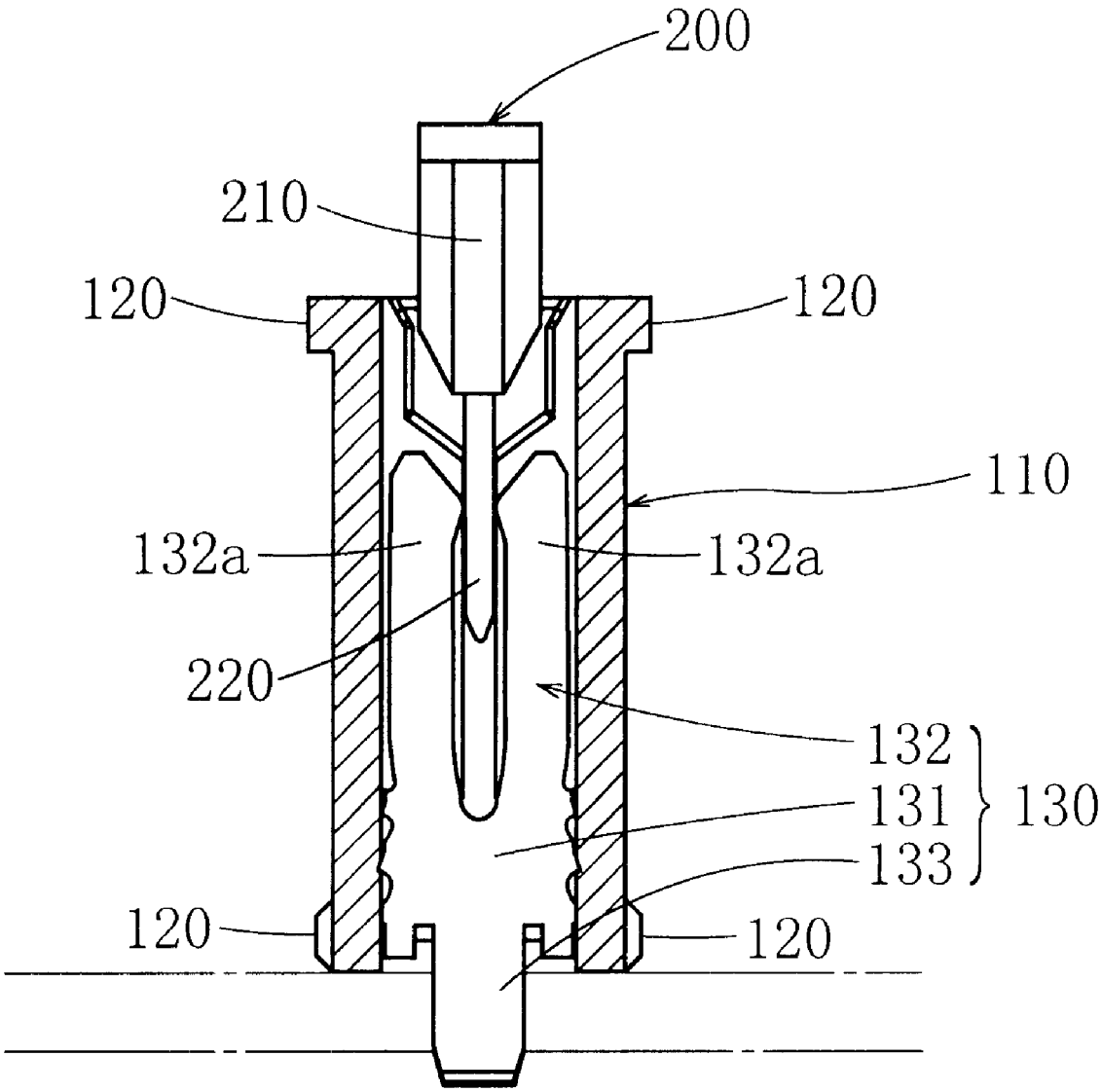
FIG. 28 is a sectional view of the fuse holder divided from the second embodiment of the multiple-fuse holder. A fuse is fitted into the fuse holder and the fuse holder is cut in both the front wall and the rear wall.

In the following, some embodiments of the multiple-fuse holder according to the present invention will be described. A fuse to be fitted into this multiple-fuse holder is a blade type fuse 200, as shown in FIG. 13 and FIG. 14 or FIG. 27 and FIG. 28, with two blade terminals 220 protruding from the body 210 thereof. These fuses 200 have been standardized. The larger fuse 200 shown in FIG. 13 and FIG. 14 is called the maxi type, and the smaller fuse 200 shown in FIG. 27 and FIG. 28 is called the mini type.

FIG. 1 through FIG. 4 show a multiple-fuse holder H of the first embodiment according to the present invention. A plurality of fuses 200 of the maxi type are fitted into this multiple-fuse holder H. The multiple-fuse holder H comprises a holder housing group h, which is a plurality of fuse holders 100 respectively comprising holder housings 110 being made of an insulator, arranged in a row and coupled together and contacts 130, which are made of a conductor and are provided two for each holder housing 110.

As shown in FIG. 5 through FIG. 11, the holder housing 110 is provided with wide walls 111, 112 at the front and the rear, and narrow walls 113, 114 on the left and the right thereof. A chamber 115, which is through from the top 110*a* to the bottom 110*b* of the holder housing 110, is formed on the inner sides of the front wall 111, the rear wall 112, the left wall 113 and the right wall 114. The front, rear, left and right herein are used for convenience to indicate relative positional relationships. Accordingly, these directions are not related to the orientation of a printed circuit board 300, onto which the fuse holder 100 is to be mounted, and to the orientation of the casing or the like, into which the printed circuit board 300 is to be loaded. When a fuse 200 is inserted into the holder housing 110 from the top side thereof, the blade terminals 220 of the fuse 200 and at least a part of the body 210 thereof will be held in the chamber 115. A portion of the holder housing 110 from a point between the top 110*a* and the bottom 110*b* and to the top 110*a* overhangs in the direction of alignment of the blade terminals 220. The body 210 of the fuse 200 is held by a horizontal wall 110*c*, which is inside the overhanging part.

The holder housing group h is formed by placing a plurality of holder housings 110 at a regular pitch and coupling each pair of adjacent holder housings 110 by means of coupling parts 120. Each coupling part 120 is integrally formed on a part of a wall of each holder housing 110. In the case of this embodiment, a plurality of the holder housings 110 are placed at a regular pitch in such a way that, of each pair of adjacent holder housings 110, the front wall 111 of one holder housing 110 opposes the rear wall 112 of the other holder housing 110. The coupling part 120 is integrally formed on a part of the front wall 111 of each holder housing 110, and the coupling part 120 is integrally formed on a part of the rear wall 112 of each holder housing 110. Moreover, the coupling part 120 of the front wall 111 is integrally formed on the rear wall 112 of the holder housing 110 on the front side, and the coupling part 120 of the rear wall 112 is integrally formed on the front wall 111 of the holder housing

110 on the rear side. The open front wall 111 or the open rear wall 112 of the holder housing 110 at two ends of the holder housing group h is not provided with the coupling part 120. The coupling parts 120 are formed simultaneously when, for example, the holder housing group h is formed, by forming coupling parts 120 simultaneously with the holder housings 110. The coupling parts 120 have such a strength that they can maintain the pitch between two adjacent holder housings 110 and yet can be broken by human force. The strength that can maintain the pitch between two holder housings 110 is, for example, a strength of maintaining the pitch without being broken when the holder housings 110 are mounted onto a printed circuit board 300, when a fuse 200 is fitted into or removed from the holder housing 110, or when the holder housings 110 are transported. The strength that can be broken by human force is the strength that can be broken when subjected to pulling or twisting by a hand or the strength that can be broken by a manually operated tool such as a knife. The coupling parts 120 are provided at a plurality of points on both the front wall 111 and the rear wall 112. For example, at a total of four points; at one point on the left and on the right at the top 110*a*, and at one point on the right and on the left at the bottom 110*b*. The holder housing group h is formed by coupling twelve holder housings 110. The present invention does not limit the positions of the coupling parts 120 to both the front wall 111 and the rear wall 112. The present invention includes embodiments wherein the coupling parts are provided on the left wall 113 and the right wall 114, and embodiments wherein these features are combined together.

Ribs 211 are formed on the side edges of the body 210 of the fuse 200 in parallel with the extending direction of the blade terminals 220. A U-shaped supporting part 116, which fits with the rib 211 of the body 210 of the fuse 200, is provided on the top of the left wall 113 and the right wall 114 of the holder housing 110. A slit 117 into which a side edge 221 of a blade terminal 220 will fit is provided in the left wall 113 and the right wall 114 of the holder housing 110.

Two bosses 118, 119 are provided on the bottom 10*b* of the holder housing 110. The bosses 118, 119 are provided in positions that are asymmetric to each other in relation to a line L, which runs, when seen from the bottom, between the front wall 111 and the rear wall 112 approximately in parallel with these walls.

An intermediate part 131 of each contact 130 is fixed to the bottom 110*b* of the holder housing 110. A fork-shaped connecting part 132 is provided on one end of the contact 130 to extend towards the inside of the chamber 115. This connecting part 132 is formed approximately into a U shape, and its two branches 132*a* are arranged to expand towards the front wall 111 and the rear wall 112 to fit with the blade terminal 220 with a certain contact pressure. A leg 133 is provided on the other end of the contact 130 to extend out of the holder housing 110. This leg 133 is soldered or press-fitted onto a printed circuit board 300.

The intermediate part 131 of the contact 130 is press-fitted into a space between the walls 111, 112 at the bottom 110*b* of the holder housing 110.

The leg 133 of the contact 130 is forked into two branches. In other words, it has two ends.

The clearances t between the connecting part 132 and the front wall 111 and the rear wall 112 of the holder housing 110 are set in such a way that they allow deformation of the connecting part 132 while limiting its excessive deformation. In other words, the clearances t are provided not to hinder expansion of the two branches 132*a* of the connecting part 132 when they are properly pushed by the blade terminal 220 to expand towards the front wall 111 and the rear wall 112. Moreover, the clearances t are provided to hold and prevent excessive deformation of the two branches 132*a* when they are pried by the blade terminal 220.

Figure 1:
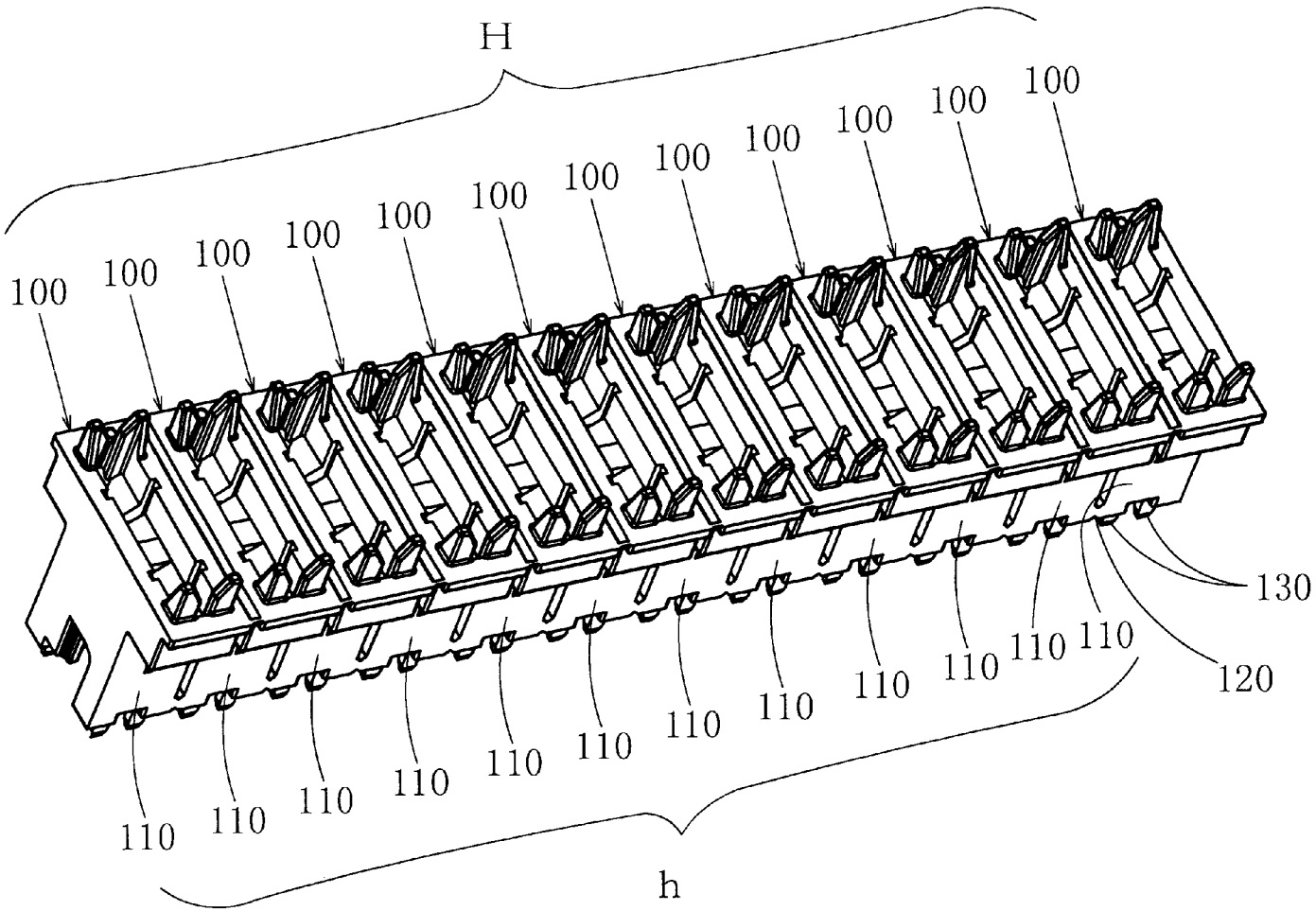
FIG. 1 is a perspective view of the first embodiment of the multiple-fuse holder according to the present invention. The multiple-fuse holder is seen from the top thereof.
Figure 2:
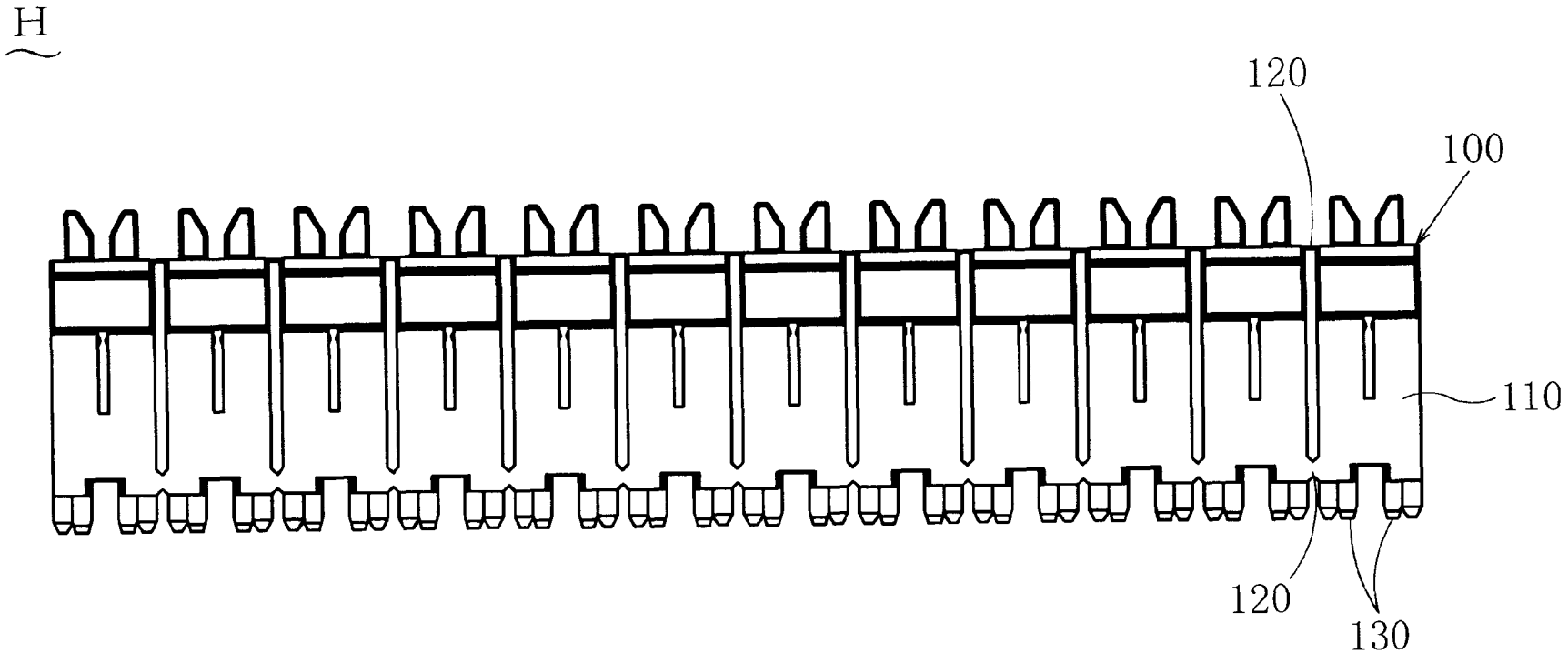
FIG. 2 is a side view of the first embodiment of the multiple-fuse holder.
Figure 3:
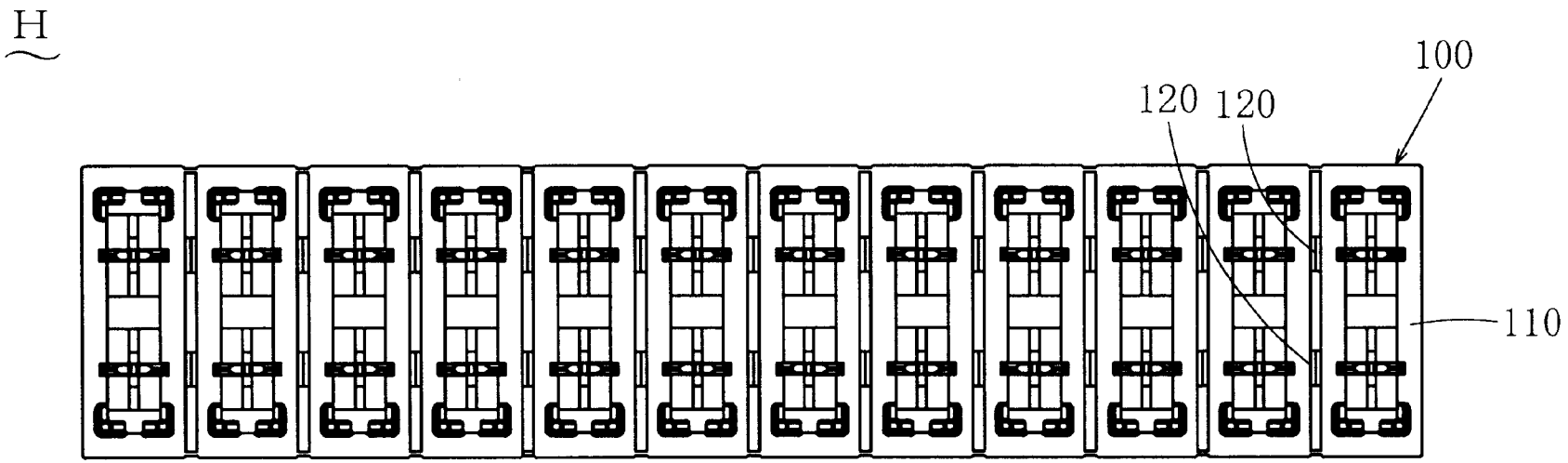
FIG. 3 is a plan view of the first embodiment of the multiple-fuse holder.
Figure 4:
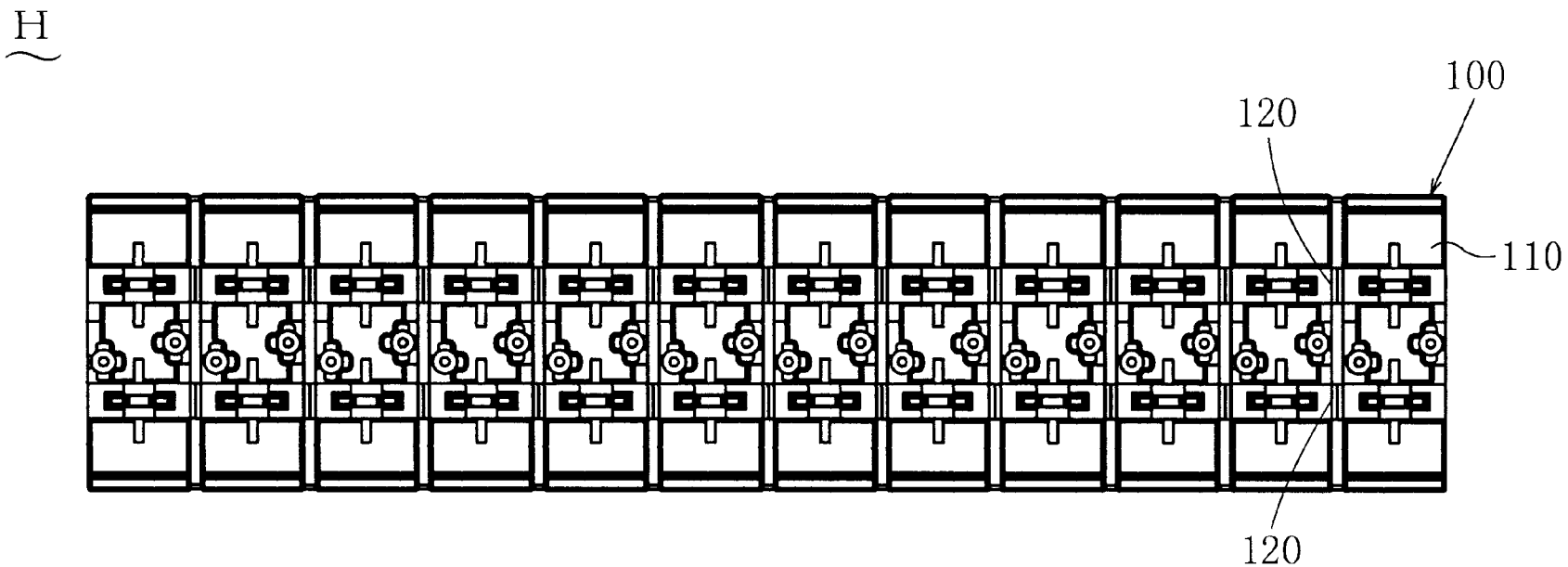
FIG. 4 is a bottom view of the first embodiment of the multiple-fuse holder.
Figure 5:
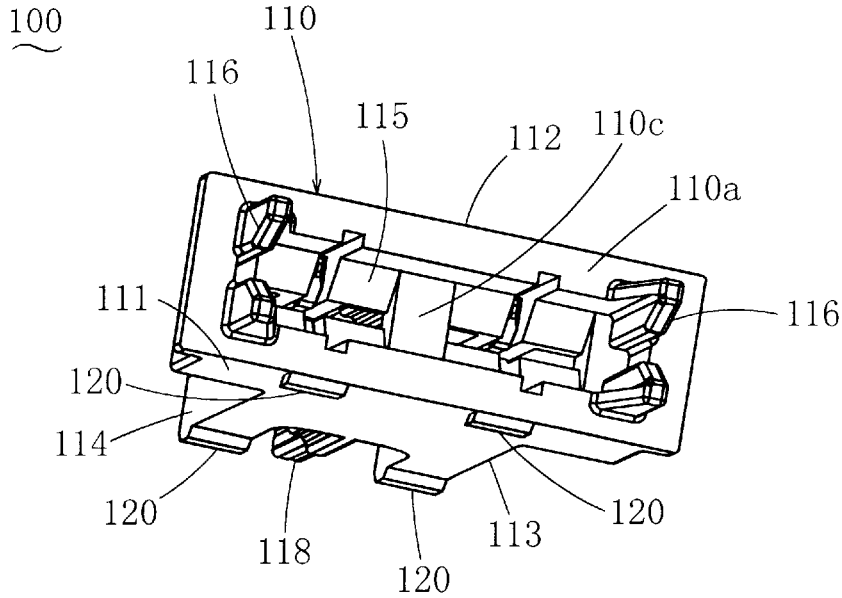
FIG. 5 is a perspective view of a fuse holder divided from the first embodiment of the multiple-fuse holder. The fuse holder is seen from the top.
Figure 6:
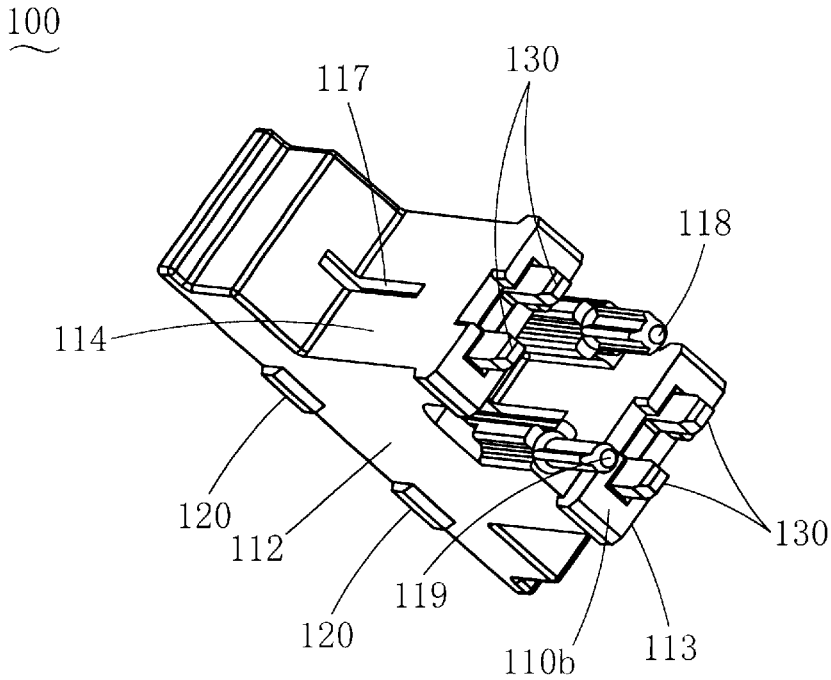
FIG. 6 is a perspective view of the fuse holder divided from the first embodiment of the multiple-fuse holder. The fuse holder is seen from the bottom.
Figure 7:
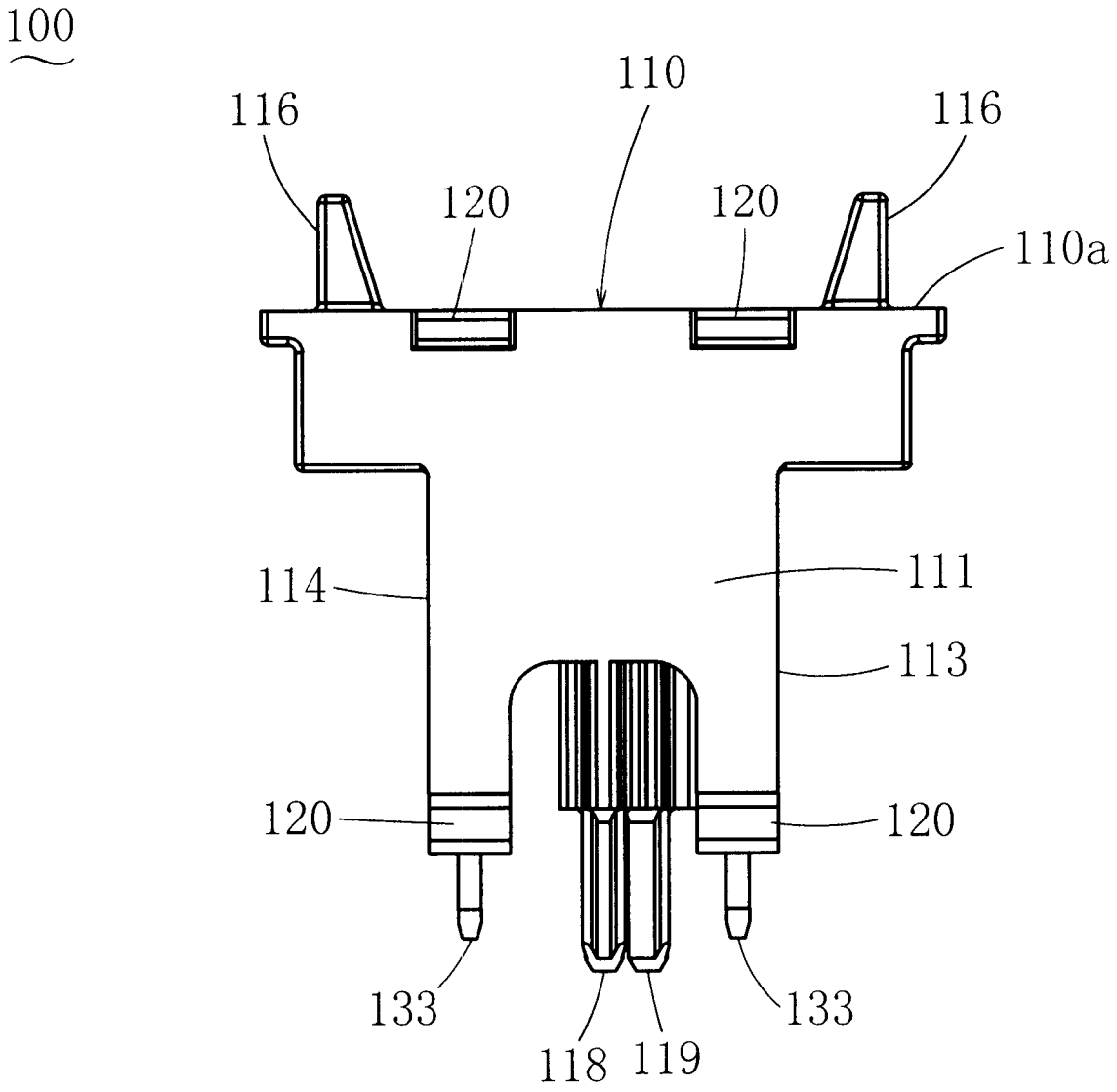
FIG. 7 is a front view of the fuse holder divided from the first embodiment of the multiple-fuse holder.
Figure 8:
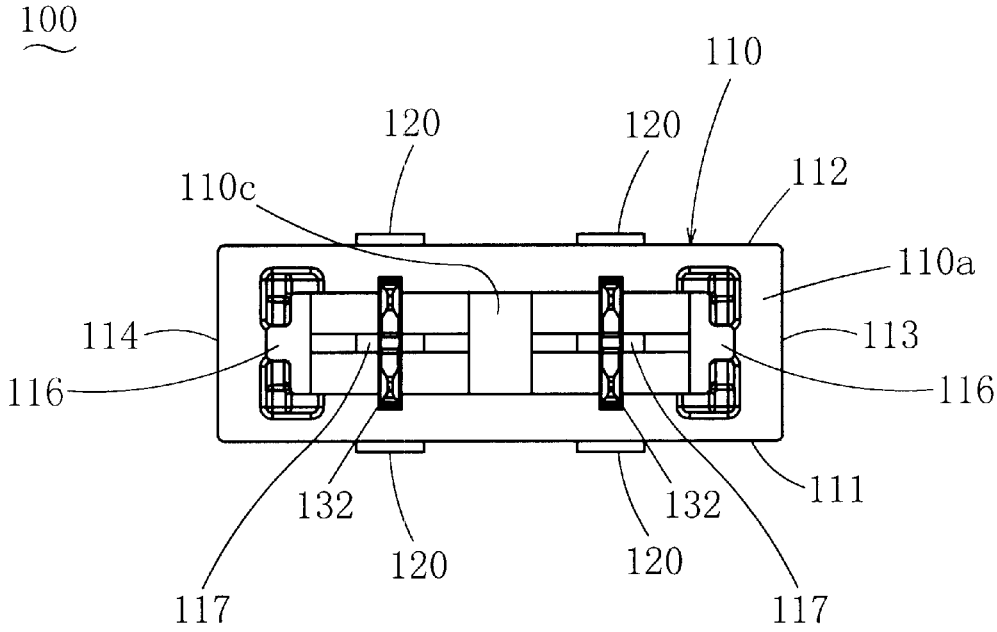
FIG. 8 is a plan view of the fuse holder divided from the first embodiment of the multiple-fuse holder.
Figure 9:
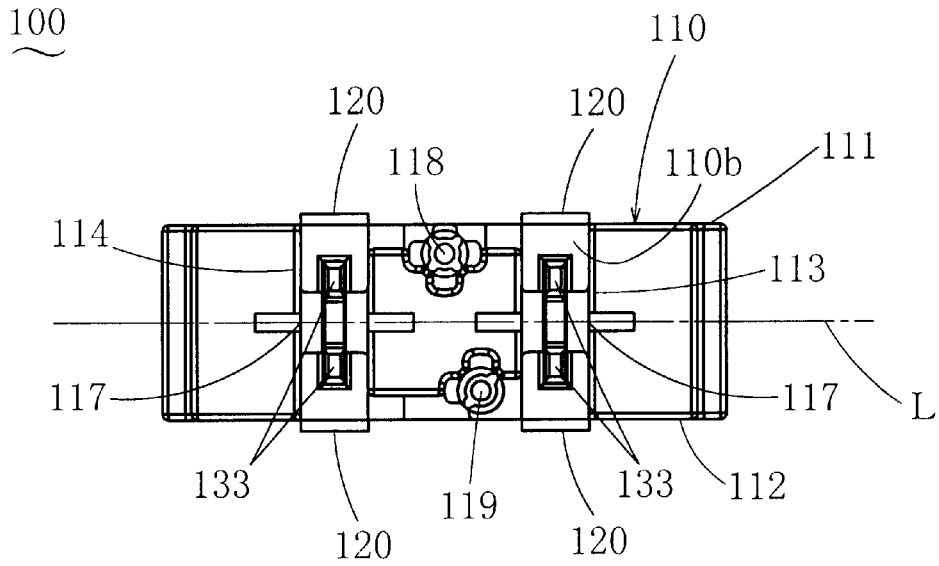
FIG. 9 is a bottom view of the fuse holder divided from the first embodiment of the multiple-fuse holder.
Figure 10:
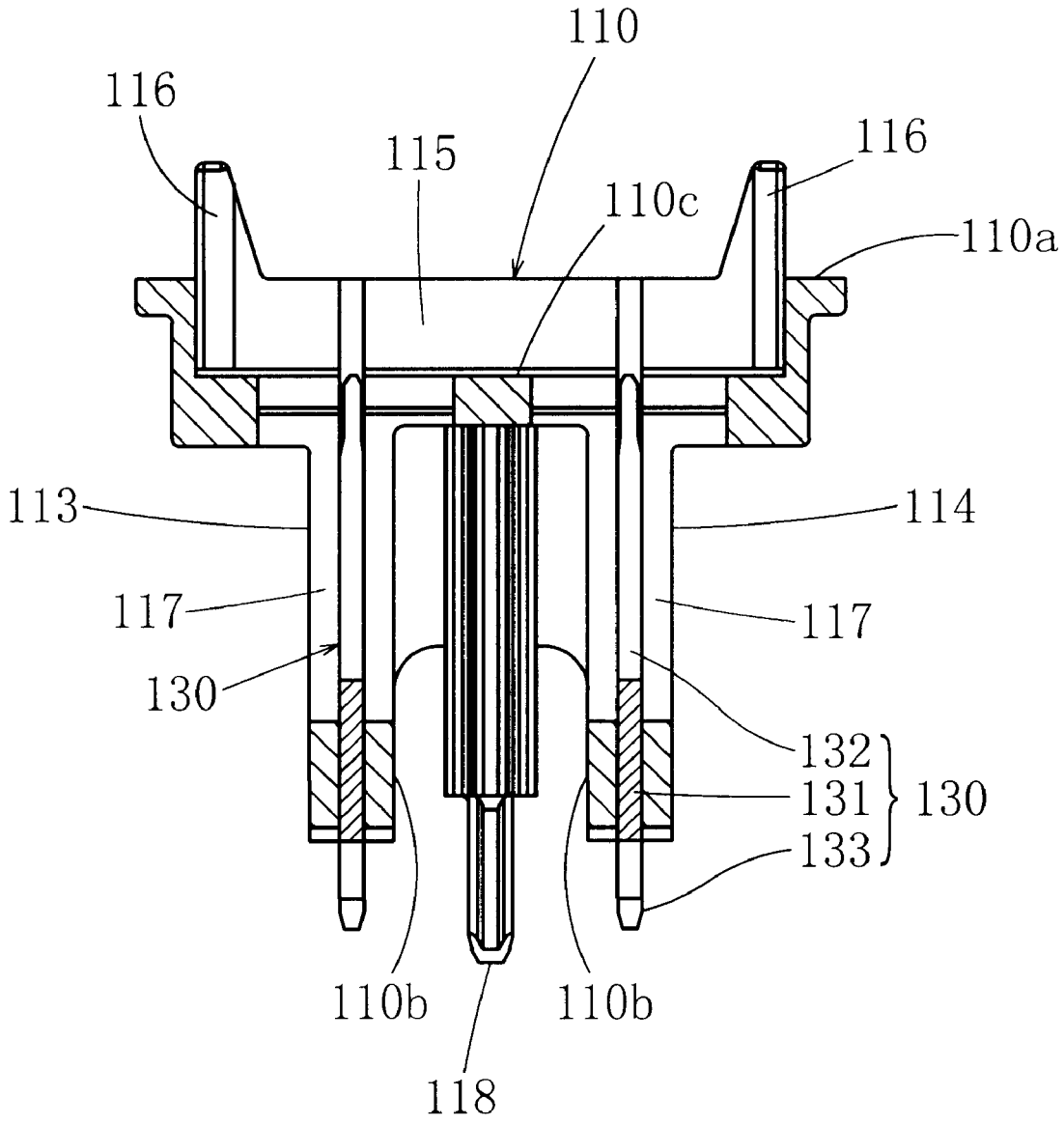
FIG. 10 is a sectional view of the fuse holder divided from the first embodiment of the multiple-fuse holder. The fuse holder is cut in both the left wall and the right wall thereof.
Figure 11:
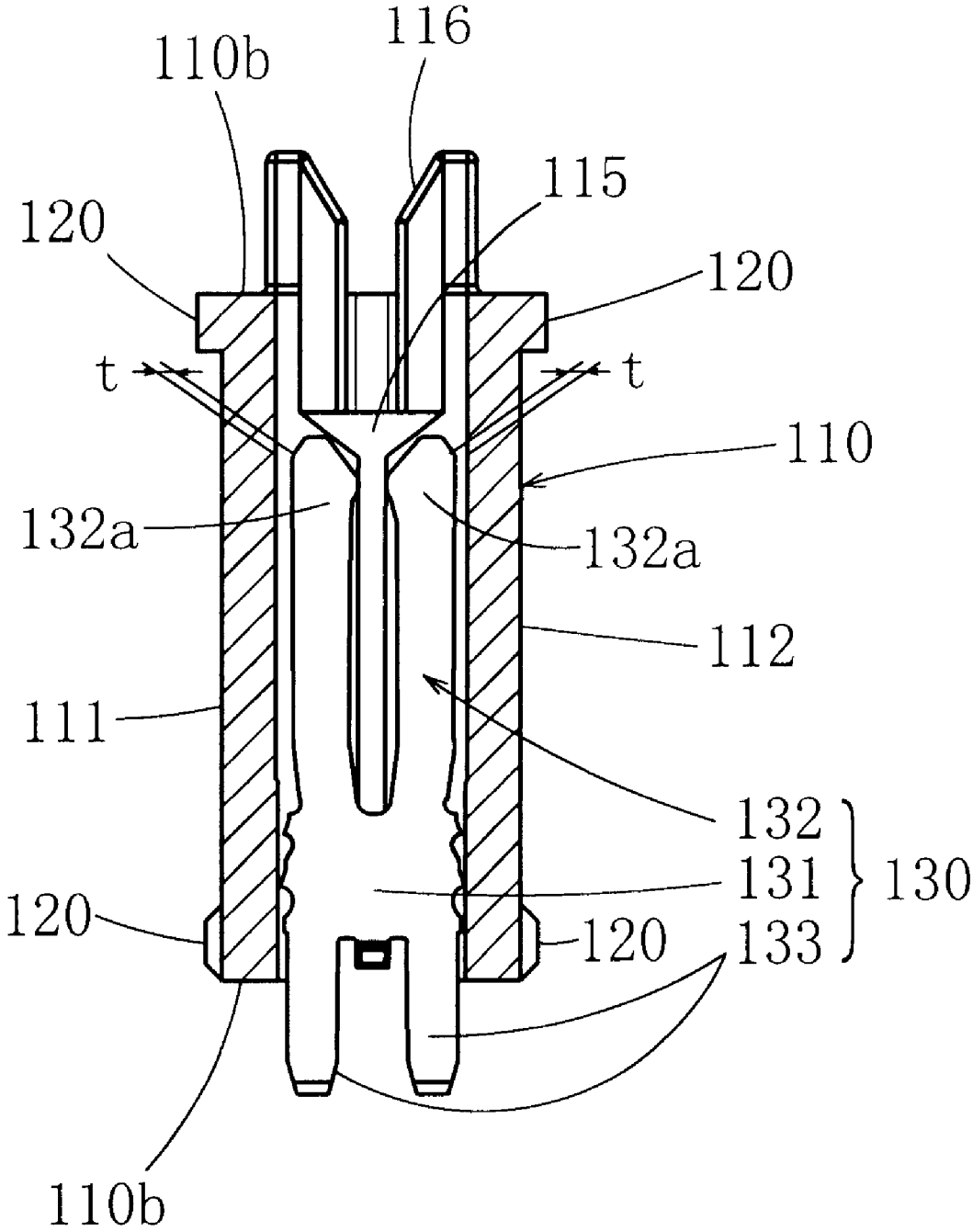
FIG. 11 is a sectional view of the fuse holder divided from the first embodiment of the multiple-fuse holder. The fuse holder is cut in both the front wall and the rear wall thereof.
Figure 12:
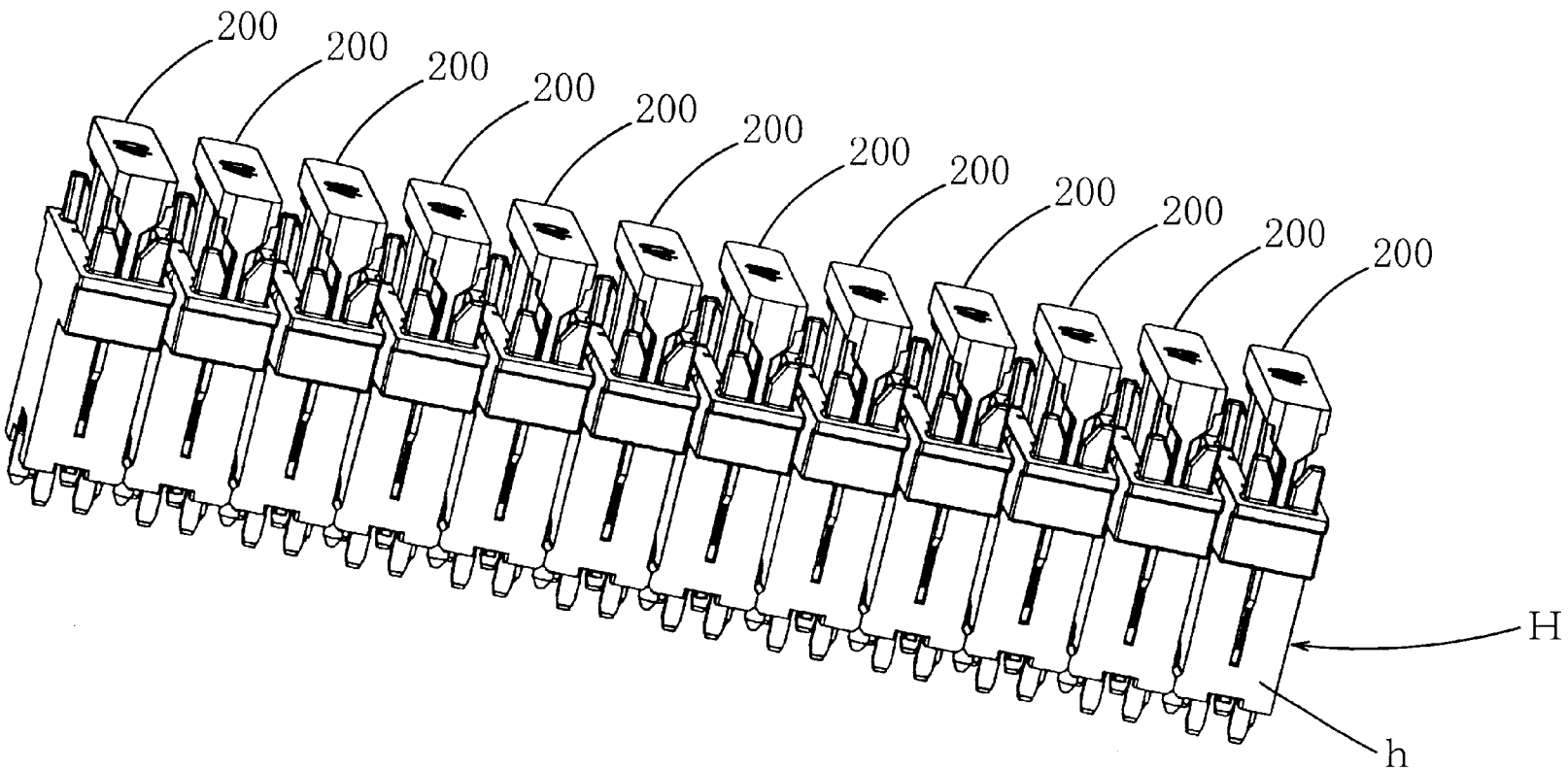
FIG. 12 is a perspective view of the first embodiment of the multiple-fuse holder with the fuses being fitted. The multiple-fuse holder is seen from the top.

Accordingly, in the case of the above-mentioned first embodiment, as shown in FIG. 12 through FIG. 14, when a fuse 200 is fitted into each holder housing 110 of the multiple-fuse holder H, the blade terminals 220 and at least a part of the body 210 will be held in the chamber 115 of each holder housing 110, and the blade terminals 220 will be fitted into the connecting parts 132 of the contacts 130. A multiple-fuse holder H or a plurality of multiple-fuse holders H is arranged on a printed circuit board 300. Or a fuse holder 100 or a plurality of fuse holders 100, which is obtained by dividing a multiple-fuse holder H, is arranged on a printed circuit board 300. When the leg 133 of each contact 130 is soldered or press-fitted onto the printed circuit board 300, the required number, singular or plural, of fuse holder 100 having a fuse 200 fitted will be mounted onto the printed circuit board 300. When conductive parts such as electric wires are connected to the pattern of the printed circuit board 300, the fuses 200 will be electrically connected to the conductive parts. When the printed circuit board 300 is loaded into a casing or the like, a fuse fitting device will be produced. When this multiple-fuse holder H is used, a fuse fitting device can be made with ease for any number of fuses 200 to be used without newly designing a block. Hence the production cost is reduced. To produce a fuse fitting device, a multiple-fuse holder H or a plurality of multiple-fuse holders H or a fuse holder 100 or a plurality of fuse holders 100 may be mounted onto the printed circuit board 300 before fitting a fuse 200 into each fuse holder 100.

The present invention does not limit the configuration of the connecting part of the contact. For example, the present invention includes embodiments wherein the connecting part is formed with a coiled spring and the contact pressure between the contact and the blade terminal is secured by the coiled spring. Among the embodiments of the present invention, in the case of the above-mentioned first embodiment, the connecting part 132 of the contact 130 is formed into a fork shape that can expand towards the front wall 111 and the rear wall 112, and the clearances t between the connecting part 132 and the front wall 111 and the rear wall 112 of the holder housing 110 are set to allow deformation of the connecting part 132 while limiting its excessive deformation. With these arrangements, as the contact 130 is fork-shaped, the production cost is lower in comparison with a case wherein contacts with coiled spring ends are used. When the connecting part 132 of the contact 130 is deformed, the connecting part 132 will be restrained from excessive deformation by the front wall 111 and the rear wall 112 of the holder housing 110, and in turn, the connecting part 132 will be prevented from being pried by the blade terminal 220.

The present invention does not limit the configuration of the coupling parts 120. Among the embodiments of the present invention, in the case of the first embodiment, the coupling part 120 has a strength that can maintain the pitch between adjacent two holder housings 110 and yet can be broken by human power. With these arrangements, the coupling parts 120 will be broken when subjected to pulling, twisting or the like by human hands, and the coupling parts 120 can be broken by manually operated tools such as a knife. Thus the multiple-fuse holder H can be divided with ease. Moreover, as the coupling parts 120 will maintain the pitch between adjacent two holder housings 110, the respective fuse holders 110 can be mounted accurately onto a printed circuit board 300.

In the case of the first embodiment, the coupling parts 120 are provided at a plurality of points on the front wall 111 and the rear wall 112. With this arrangement, the strength of the coupling parts against twisting will be improved, and this is desirable under conditions in which the coupling parts 120 are subjected to twisting forces in production or in use.

The present invention does not limit the number of holder housings that constitute a holder housing group. Among the embodiments of the present invention, in the case of the first embodiment, the holder housing group h comprises twelve holder housings 110 coupled together. With this arrangement, the multiple-fuse holder H can be utilized effectively, without generating any odd or waste, by dividing it when the number of fuses 200 to be used is 12, 6, 4, 3, 2 or 1.

The present invention includes embodiments wherein the holder housing is not provided with a supporting part. Among the embodiments of the present invention, in the case of the first embodiment, a supporting part 116 is provided on the top of the left wall 113 and the right wall 114 of the holder housing 110. With this arrangement, when the ribs 211 are fitted into the supporting parts 116, the relative positions of the fuse 200 and the fuse holder 100 to each other will be determined accurately, and the blade terminals 220 will be prevented from prying the connecting parts 132. Moreover, the fuse 200 will be held more reliably by the fuse holder 100.

The present invention includes embodiments wherein the holder housing is not provided with any slit. Among embodiments of the present invention, in the case of the first embodiment, the holder housing 110 is provided with slits 117. With this arrangement, fitting the side edges 221 into the slits 117 will accurately determine the relative positions of the fuse 200 and the fuse holder 100 to each other, and the blade terminals 220 will be prevented from prying the connecting parts 132. Moreover, the fuse 200 will be held more securely in the fuse holder 100.

The present invention does not limit the structure for fixing the intermediate part of the contact to the holder housing. Among the embodiments of the present invention, in the case of the above-mentioned first embodiment, the intermediate part 131 of the contact 130 is press-fitted into a space between the walls 111, 112 at the bottom 110*b* of the holder housing 110. With this arrangement, the operation is easier among the production methods of forming the contacts 130 and molding the holder housing 110 separately and combining them together.

The present invention does not limit the configuration of the leg 133 of the contact 130. Among the embodiments of the present invention, in the case of the above-mentioned first embodiment, the leg 133 of the contact 130 is formed into two branches. With this arrangement, the contact 130 will be connected to the printed circuit board 300 at two points, and defective connection will hardly occur.

The present invention includes embodiments wherein the holder housings are not provided with bosses. Among the embodiments of the present invention, in the case of the above-mentioned first embodiment, the bottom 110*b* of the holder housing 110 is provided with two bosses 118, 119 in positions that are asymmetric to each other in relation to a line L, which runs, when seen from the bottom, between the front wall 111 and the rear wall 112. With this arrangement, if holes corresponding to the bosses 118, 119 are made in the printed circuit board 300 in advance, mounting the fuse holder 100 on the printed circuit board 300 in a wrong orientation can be prevented.

In the following, other embodiments will be described. The description of the first embodiment will apply in its entirety as the description of each embodiment, and the same reference character will be used for the same member, and only parts that differ in construction from those of the first embodiment will be described.

FIG. 15 through FIG. 28 show the second embodiment multiple-fuse holder H and fuse holders 100 that constitute it. The mini-type fuse 200 is fitted into this fuse holder 100. The fuse holder 100 differs from the fuse holder 100 of the first embodiment in the following points. As the fuse 200 has no ribs 211, the holder housing 100 is not provided with supporting parts 116. The leg 133 of the contact 130 is not forked into two branches. However, the embodiments of the fuse holder 100, into which the mini-type fuse 200 is fitted, include embodiments wherein the leg 133 of the contact 130 is forked into two branches.

Figure 29:
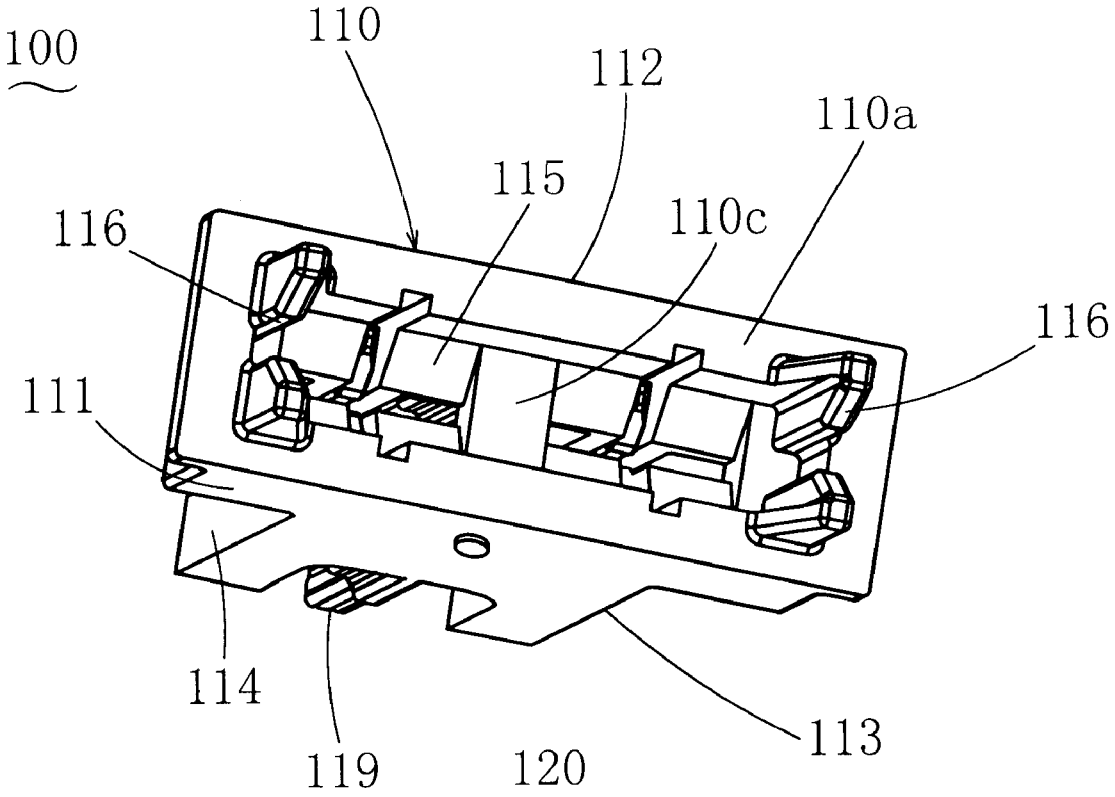
FIG. 29 is a perspective view of a fuse holder divided from the third embodiment of the multiple-fuse holder according to the present invention. The fuse holder is seen from the top.
Figure 30:
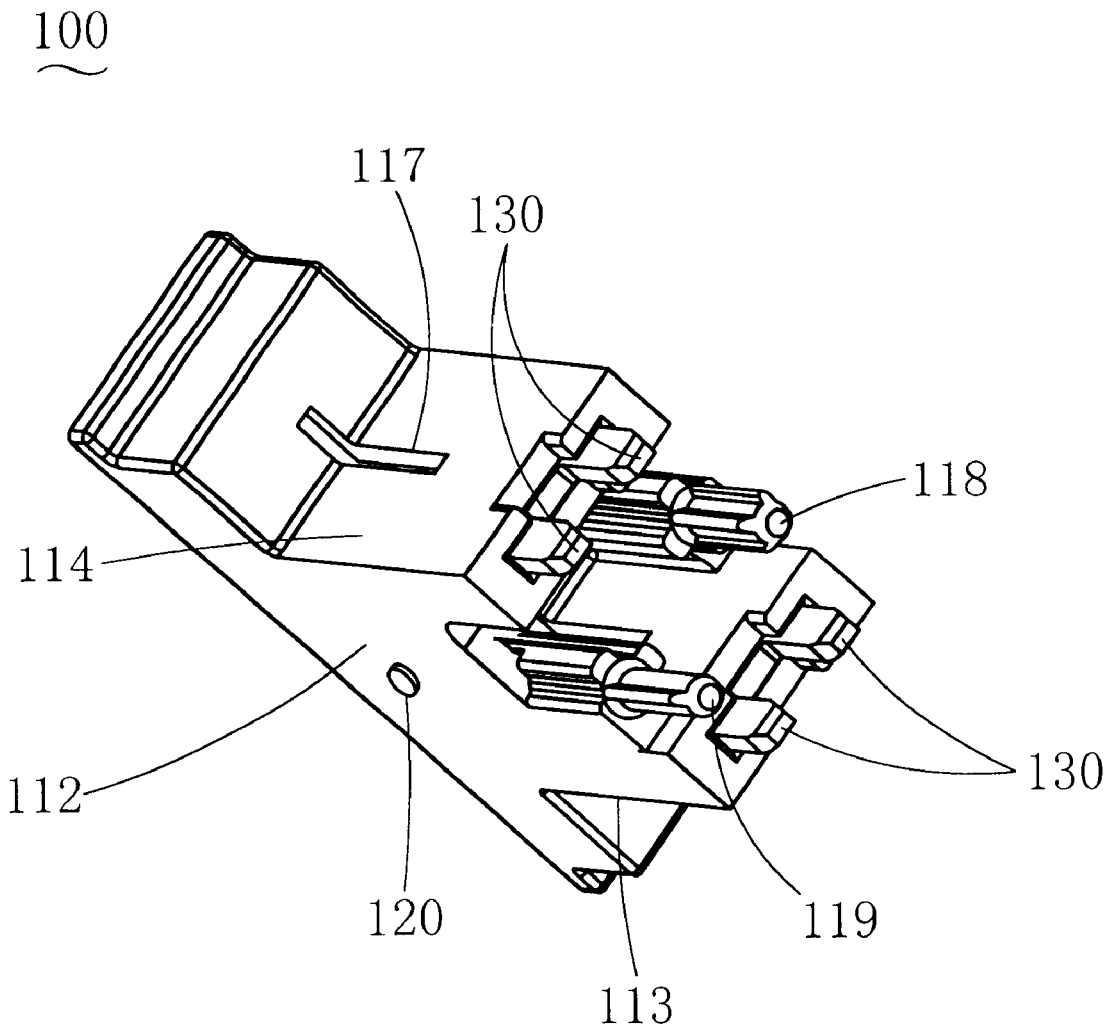
FIG. 30 is a perspective view of the fuse holder divided from the third embodiment of the multiple-fuse holder. The fuse holder is seen from the bottom.

FIG. 29 and FIG. 30 show a fuse holder which constitutes the third embodiment multiple-fuse holder H. This fuse holder differs from that of the first embodiment in the structure of the coupling part 120. In the third embodiment, the coupling part 120 is provided only at a point on the front wall 111 and on the rear wall 112. For example, the coupling part 120 is provided at a point almost at the center of the front wall 111 and of the rear wall 112. With this arrangement, the multiple-fuse holder H can be easily divided, without any use of a jig, by twisting adjacent two fuse holders 100 against each other and wrenching off the coupling part 120. Thus the operation at the time of use can be done efficiently.

Figure 31:
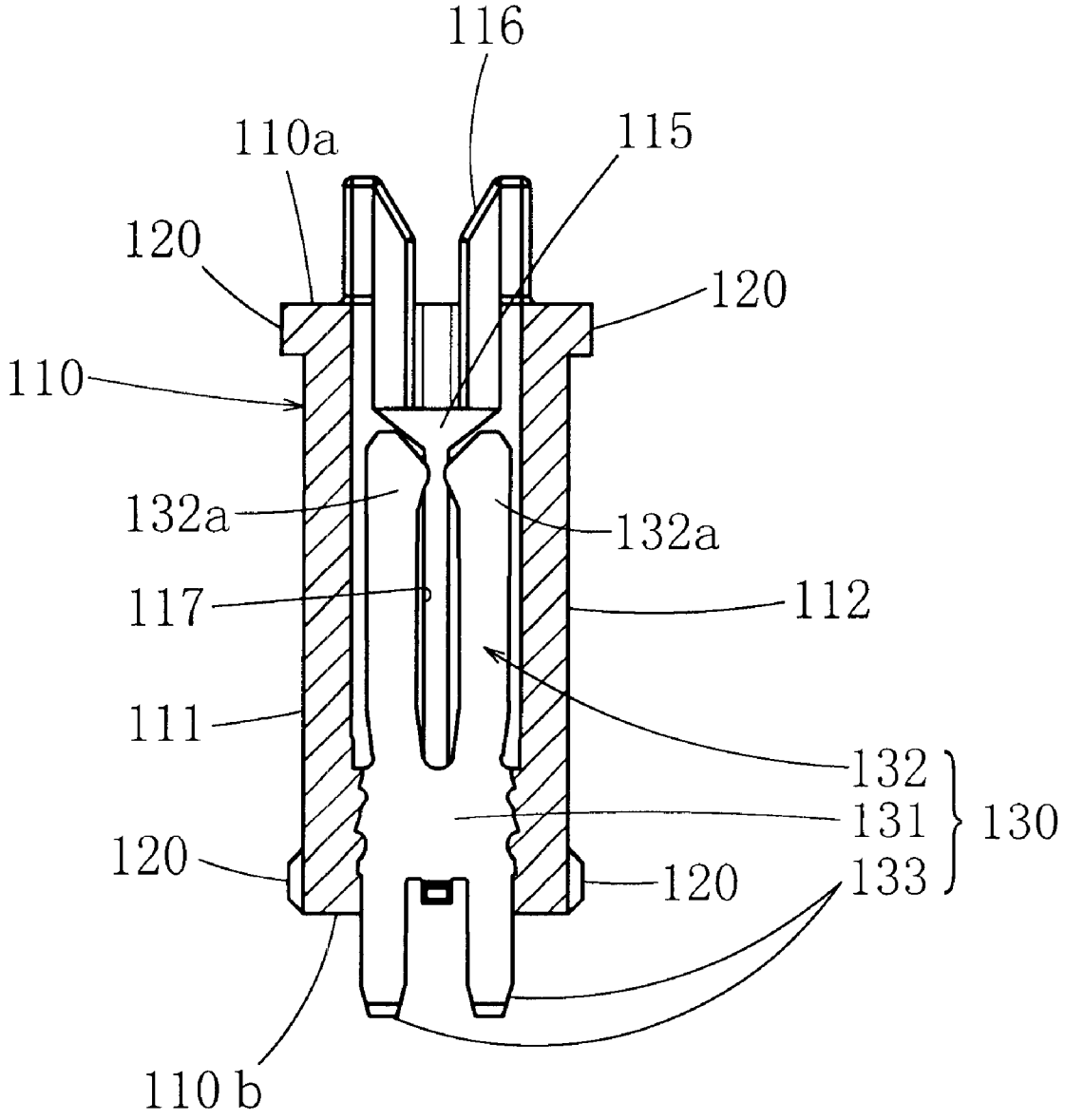
FIG. 31 is a sectional view of a fuse holder divided from the fourth embodiment of the multiple-fuse holder according to the present invention. The fuse holder is cut in both the front wall and the rear wall.

FIG. 31 shows the fuse holder of the fourth embodiment. This fuse holder differs from that of the first embodiment in the method of fixing the contact 130 to the holder housing 110. In the fourth embodiment, the intermediate parts 131 of the contacts 130 are enveloped-cast in the holder housing 110. Enveloped-casting means that a material in a molten state sticks to the circumference of an object and solidifies over it. When the fuse holder 100 is to be produced, contacts 130 are set in a mold for the holder housing 110, then the material is filled into the mold to form the holder housing 110. In this way, the relative positions of the contacts 130 and the holder housing 110 will be determined with high precision.

Figure 32:
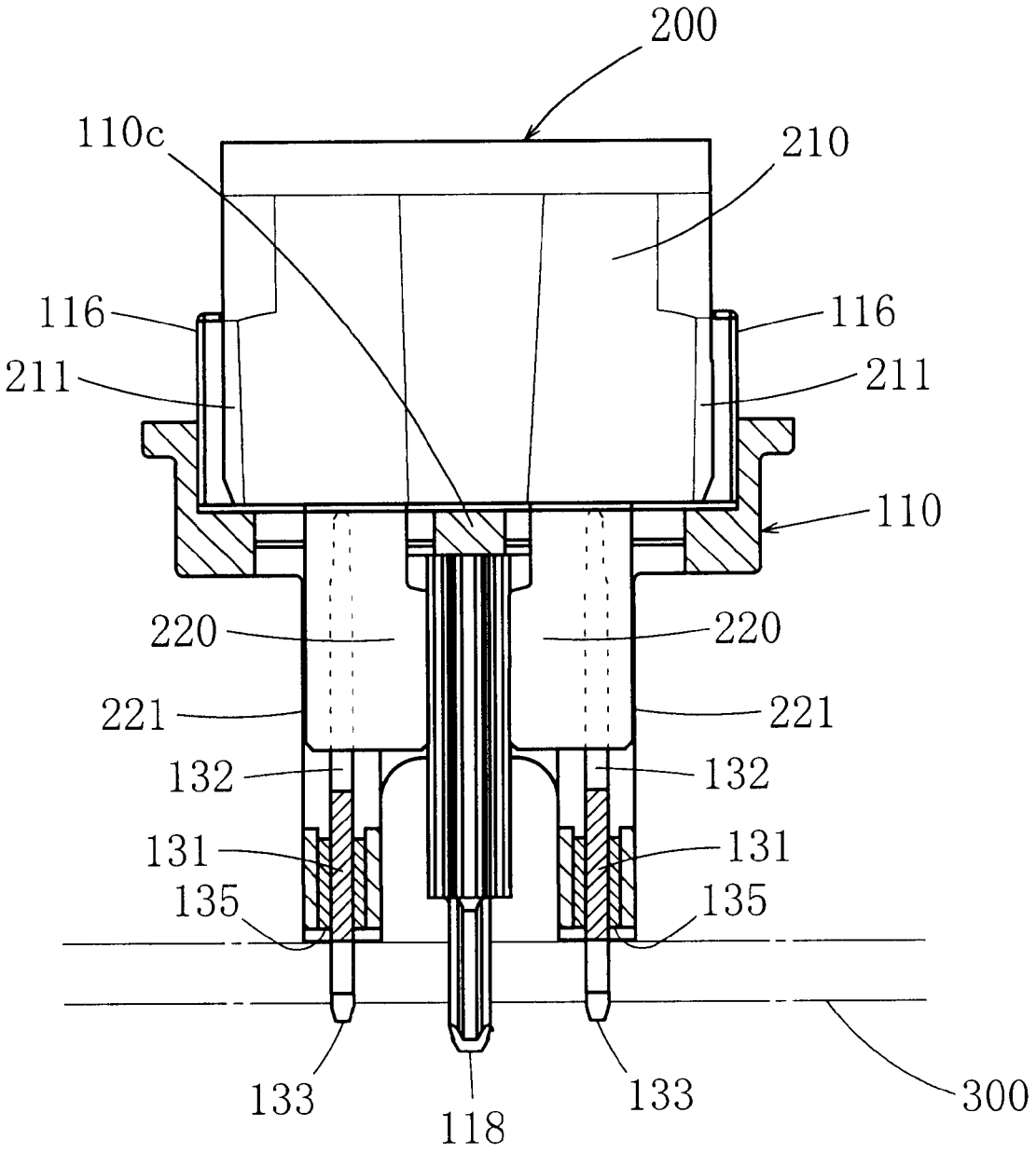
FIG. 32 is a sectional view of a fuse holder divided from the fifth embodiment of the multiple-fuse holder. The fuse holder is cut in both the left wall and the right wall.
Figure 33:
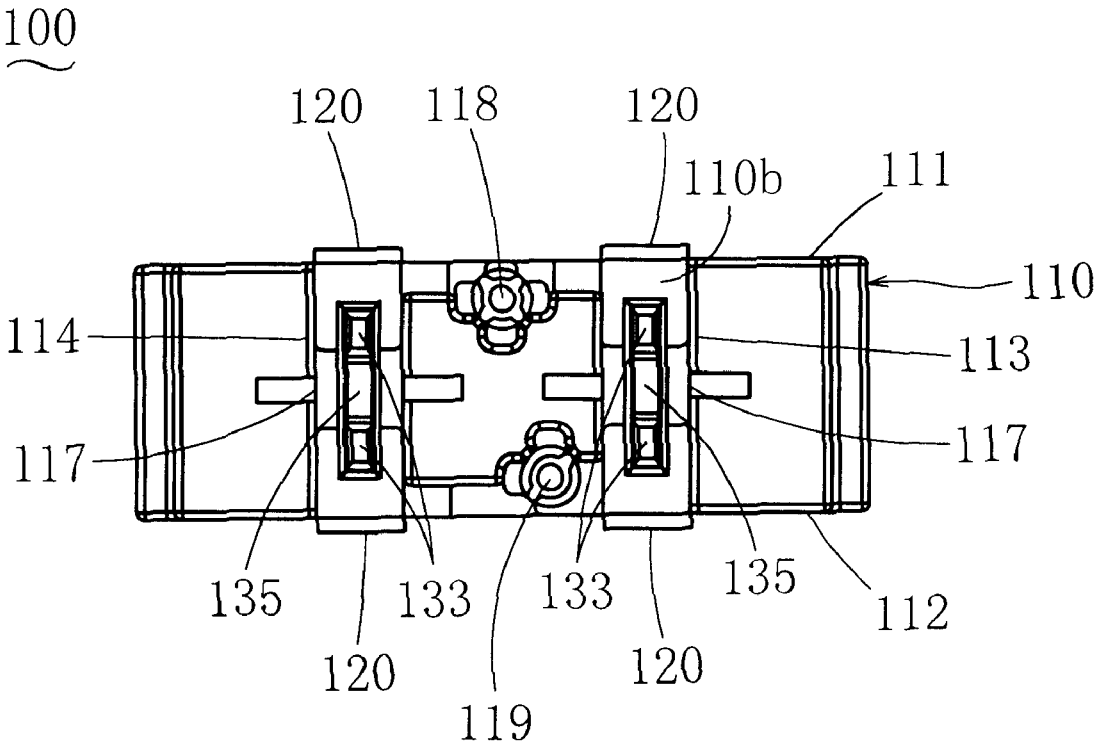
FIG. 33 is a bottom view of the fuse holder divided from the fifth embodiment of the multiple-fuse holder.
Figure 34:
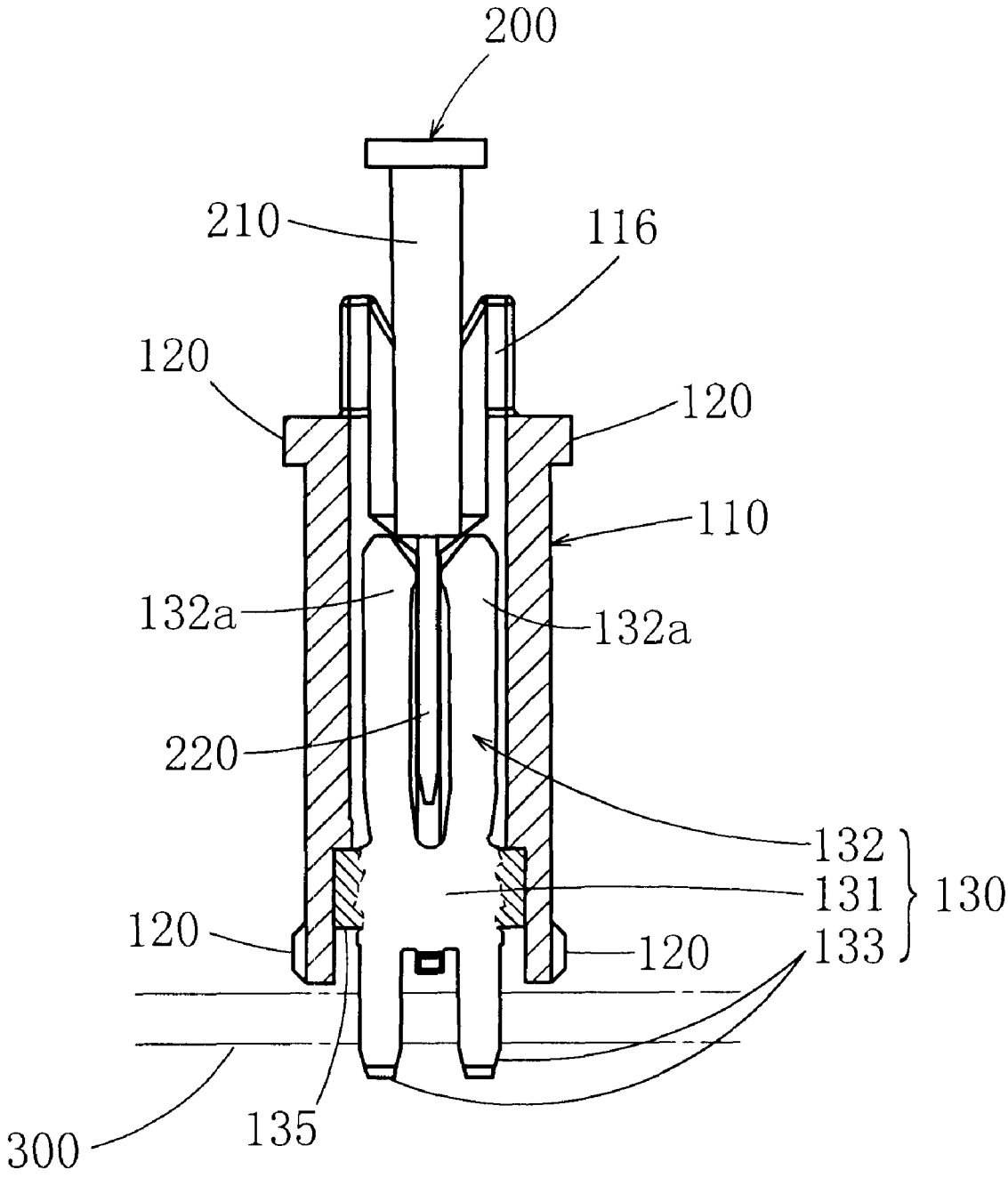
FIG. 34 is a sectional view of the fuse holder divided from the fifth embodiment of the multiple-fuse holder. The fuse holder is cut in both the front wall and the rear wall.

FIG. 32 through FIG. 34 show the fuse holder of the fifth embodiment. This embodiment differs from the first embodiment in the method of fixing the contacts 130 to the holder housing 110. In the fifth embodiment, the intermediate part 131 of the contact 130 is enveloped-cast in an insert 135, and this insert 135 is fitted into a space among the walls 111 through 114 at the bottom 110*b* of the holder housing 110. With this arrangement, molding the holder housing 110 and enveloped-casting the insert 135 are done separately, and they can be done under optimal conditions.

Figure 35:
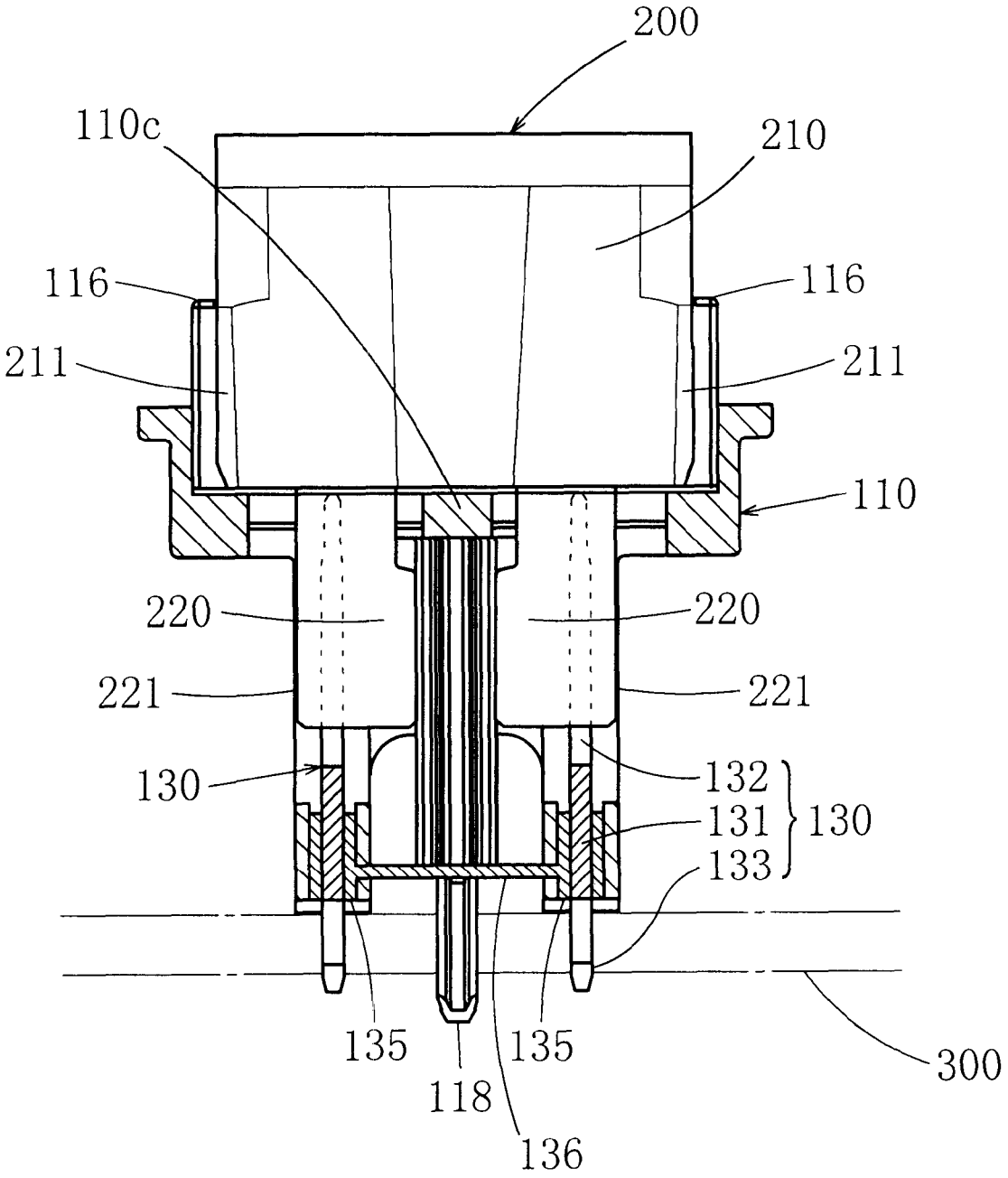
FIG. 35 is a sectional view of a fuse holder divided from the sixth embodiment of the multiple-fuse holder. The fuse holder is cut in both the left wall and the right wall.
Figure 36:
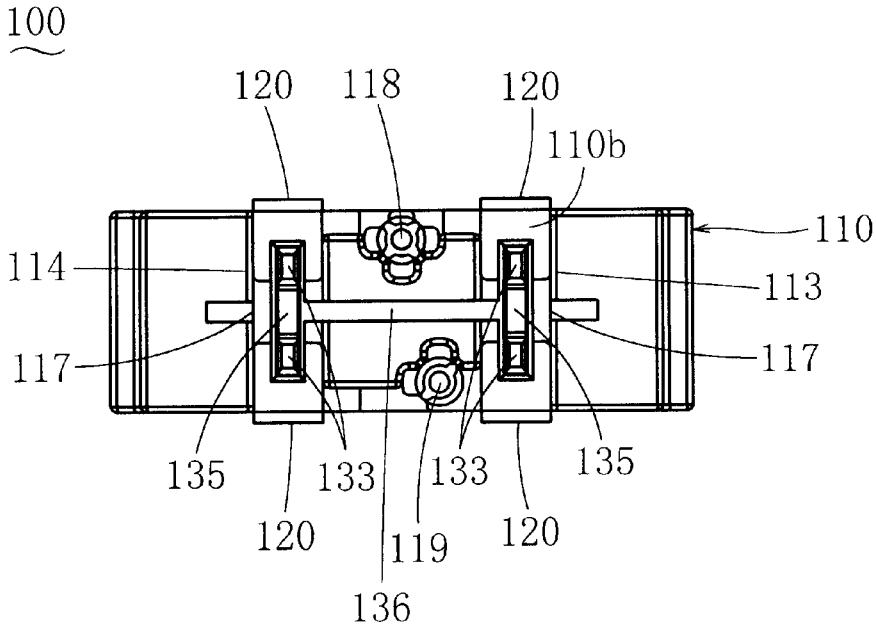
FIG. 36 is a bottom view of the fuse holder divided from the sixth embodiment of the multiple-fuse holder.

FIG. 35 and FIG. 36 show the fuse holder of the sixth embodiment. The sixth embodiment differs from the fifth embodiment in the configuration of the insert. The two inserts 135 corresponding to the respective contacts 130 are coupled by a bridge 136. With this arrangement, inserting the inserts 135 having the contact 130 into the holder housing 110 can be done by a single operation.

The present invention does not limit the material of the insert 135. However, when the insert 135 is formed of a material of which heat resistance is superior to that of the holder housing 110, the heat resistance of the holder housing 110 will not pose any problem even if the inserts 135 are subjected to heat of soldering. Hence the holder housing 110 can be made of a more inexpensive material.

Figure 37:
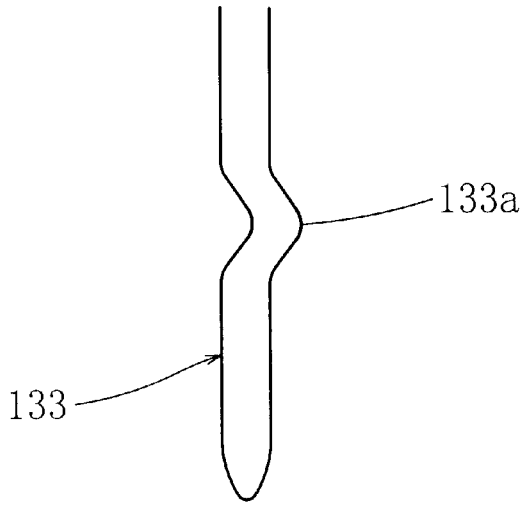
FIG. 37 is an enlarged view showing the leg of the contact of the seventh embodiment of the multiple-fuse holder.
Figure 38:
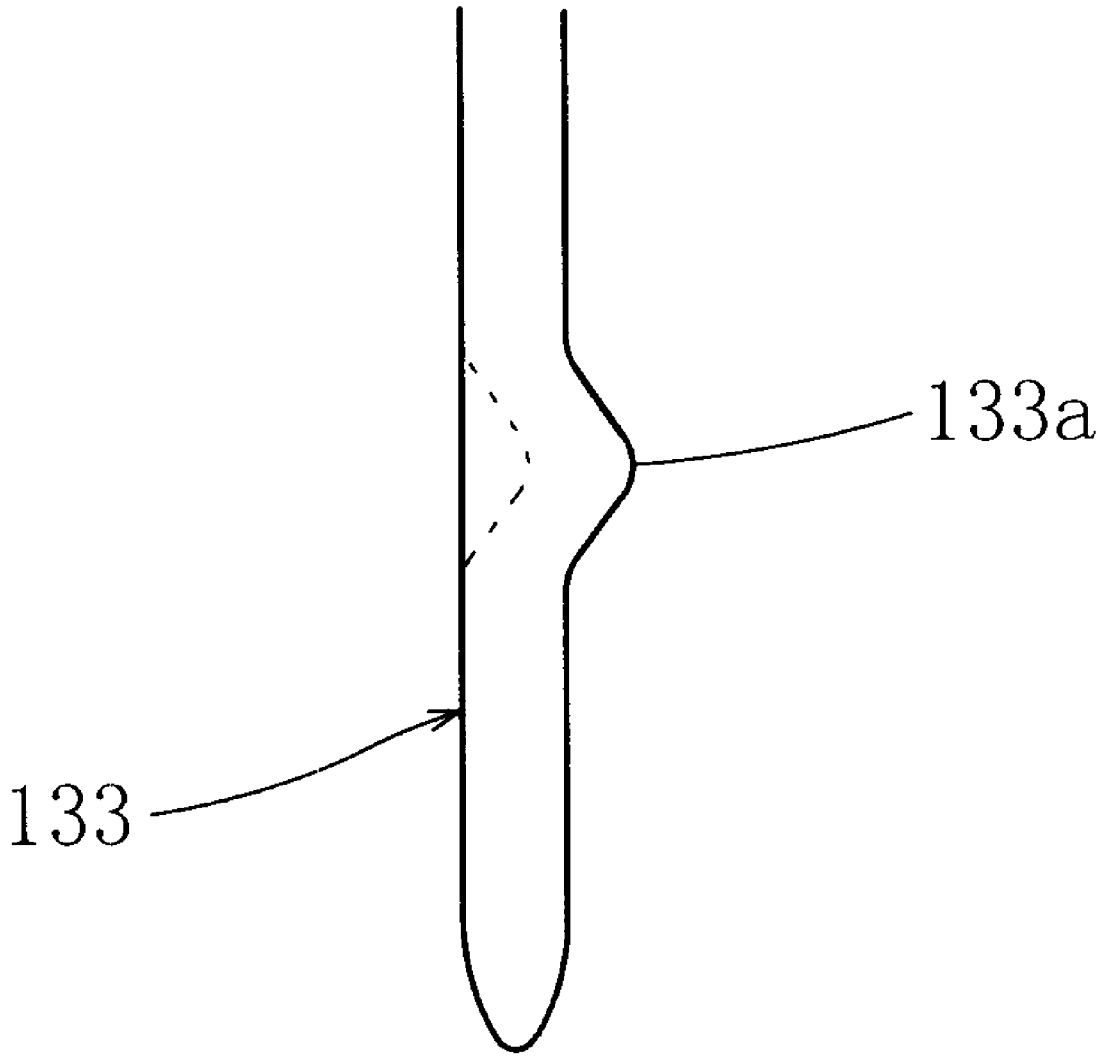
FIG. 38 is an enlarged view showing a modification of the leg of the contact of the seventh embodiment of the multiple-fuse holder.

FIG. 37 and FIG. 38 show the fuse holder of the seventh embodiment. In this embodiment, a protrusion 133*a* is formed in the leg 133 of the contact 130. This protrusion 133*a* is also called a clinch. The protrusion 133*a* may be formed, as shown in FIG. 37, by bending the leg 133 sidewise to form a V shape, or as shown in FIG. 38, by making a part of the leg 133 protrude sidewise. With this arrangement, when the leg 133 of the contact 130 is to be tacked onto a printed circuit board 300 before soldering, fitting the leg 133 of the contact 130 into a hole in the printed circuit board 300 will generate a greater fitting force at the protrusion 133*a*. Thus tacking can be done reliably.

The present invention does not limit the color of the holder housing 110. However, if the holder housing 110 has the same color as that of the body 210 of the fuse 200, the proper fuse 200 for the fuse holder 100 can be identified easily.

The present invention includes embodiments that combine features of the above-mentioned embodiments.

With the description of these embodiments, the first multiple-fuse holder, which was described in the summary of the invention, has been fully disclosed. Moreover, with the description of these embodiments, the second multiple-fuse holder through the fifteenth multiple-fuse holder, which will be described below, have been fully explained.

The second multiple-fuse holder is a multiple-fuse holder as recited in the above-mentioned first multiple-fuse holder, wherein the connecting part of the contact is formed into a fork shape, which can be expanded towards the front wall and the rear wall of the holder housing, and the clearances between the connecting part and the front wall and the rear wall are set in such a way that they allow deformation of the connecting part while limiting its excessive deformation. With this arrangement, as the contact has a fork shape, the production cost is lower than that of a contact having a coiled spring at the top end thereof. When the connecting part of the contact is deformed, the connecting part will be prevented from excessive deformation by the front wall and the rear wall of the holder housing, thus the connecting part will be prevented from being pried by the blade terminal. Hence a high level of performance of the fuse fitting device can be guaranteed.

The third multiple-fuse holder is a multiple-fuse holder as recite in the above-mentioned first or second multiple-fuse holder, wherein the coupling parts have a strength that ca maintain the pitch between adjacent two holder housings and yet can be broken by human force. With this arrangement, the coupling parts can be broken by an action such as pulling or twisting by a human hand, or the coupling parts an be broken by means of a manually operated tool such as a knife, and in turn, the multiple-use holder can be divided easily. Moreover, as the coupling part maintain the pitch between adjacent two holder housings, each fuse holder can be mounted onto a printed circuit board accurately.

The fourth multiple-fuse holder is a multiple-fuse holder as recited in any one of the above-mentioned first through third multiple-fuse holders, wherein the coupling parts are provided at a plurality of points on the wall. With this arrangement, the strength of the coupling parts against twisting is enhanced, and this is desirable under conditions in which the coupling parts are subjected to twisting force in production or in use.

The fifth multiple-fuse holder is a multiple-fuse holder as recite in any one of the above mentioned first through third multiple-fuse holders, wherein the coupling part is provided at a single point on the wall. With this arrangement, the multiple-fuse holder can be easily divided, without any use of a tool, by wrenching and breaking the coupling part.

The sixth multiple-fuse holder is a multiple-fuse holder as recited in any one of the above-mentioned first through fifth multiple-fuse holders, wherein the holder housing group comprises twelve holder housings coupled together. With this arrangement, the multiple-fuse holder can be utilized fully, without generating any odd or waste, by dividing it when the number of fuses to be used is 12, 6, 4, 3, 2 or 1.

The seventh multiple-fuse holder is a multiple-fuse holder as recited in any one of the above-mentioned first through sixth multiple-fuse holders, wherein the intermediate parts of the contacts are press-fitted into a space among the walls of the holder housing. With this arrangement, the operation is simpler among the production methods of separately forming the contacts and the holder housing and assembling them together. Thus the multiple-fuse holder can be produced with high efficiency.

The eighth multiple-fuse holder is a multiple-fuse holder as recited in any one of the above-mentioned first through sixth multiple-fuse holders, wherein the intermediate parts of the contacts are enveloped-cast in the holder housing. With this arrangement, the relative positions of the contacts and the holder housing can be determined with high precision to each other.

The ninth multiple-fuse holder is a multiple-fuse holder as recited in any one of the above-mentioned first through sixth multiple-fuse holders, wherein the intermediate part of the contact is enveloped-cast in an insert and this insert is fitted into a space among the walls of the holder housing. With this arrangement, molding of the holder housing and enveloped-casting of inserts are made separately, and each can be done under optimal conditions.

The tenth multiple-fuse holder is a multiple-fuse holder as recited in the above-mentioned ninth multiple-fuse holders, wherein two inserts are coupled together. With this arrangement, inserting the inserts having the contact into the holder housing can be done by a single operation. Thus the efficiency of the assembly can be enhanced.

The eleventh multiple-fuse holder is a multiple-fuse holder as recited in the above-mentioned ninth or tenth multiple-fuse holder, wherein the insert is formed of a material of which heat resistance is superior to that of the holder housing. With this arrangement, the heat resistance of the holder housing will not pose any problem even if the insert is subjected to heat of soldering. Hence the holder housing can be made of a more inexpensive material.

The twelfth multiple-fuse holder is a multiple-fuse holder as recited in any one of the above-mentioned first through eleventh multiple-fuse holders, wherein the leg of the contact is forked into two branches. With this arrangement, the contact will be connected to the printed circuit board at two points, and defective connection can be prevented.

The thirteenth multiple-fuse holder is a multiple-fuse holder as recited in any one of the above-mentioned first through twelfth multiple-fuse holders, wherein a protrusion is formed in the leg of the contact. With this arrangement, when the leg of the contact is to be tacked onto a printed circuit board before soldering, fitting the leg of the contact into a hole in the printed circuit board will generate a greater fitting force at the protrusion. Thus tacking will be done reliably.

The fourteenth multiple-fuse holder is a multiple-fuse holder as recited in any one of the above-mentioned first through thirteenth multiple-fuse holders, wherein the bottom of the holder housing is provided with two bosses in positions that are asymmetric to each other in relation to a line which runs, when seen from the bottom, between the front wall and the rear wall approximately in parallel with these walls. With this arrangement, when holes corresponding to the bosses are made in advance in the printed circuit board, mounting, in wrong orientation, of the fuse holder on the printed circuit board will be prevented.

The fifteenth fuse holder is a multiple-fuse holder as recited in any one of the above-mentioned first through fourteenth multiple-fuse holders, wherein the holder housing has the same color as that of the body of the fuse. With this arrangement, the proper fuse for the fuse holder can be identified easily.

What is claimed is:

1. A multiple-fuse holder into which a plurality of blade type fuses, with blade terminals protruding from the bodies thereof, are fittable, said multiple-fuse holder comprising a holder housing group including a plurality of holder housings, which each have a chamber for holding the blade terminals and a least a part of the body of a fuse inserted from above, wherein the chamber is formed with wide walls at the front and the rear and narrow walls on the right and the left, wherein the holder housings are arranged at a constant pitch and each pair of adjacent holder housings re coupled together by coupling parts, each of which is integrally formed on a part of a wall of the holder housings, and respectively two contacts provided for each holder housing, wherein each contact has an intermediate part fixed to the hold r housing, a connecting part, at one end of the contact, tending into the chamber to fit with a blade terminal, a d a leg, at another end of the contact, extending out of the holder housing to be soldered or press-fitted onto a printed circuit board, wherein the intermediate part of the contact is envelope-cast in an insert and this insert is fitted into a space among the walls of the holder housing, and wherein two of the inserts are coupled together.

2. A multiple-fuse holder as recited in claim 1, wherein the connecting part of the contact is formed into a fork shape, which can be expanded towards the front wall and the rear wall of the holder housing, and the clearances between the connecting part and the front wall and the rear wall are set in such a way that they allow deformation of the connecting part while limiting its excessive deformation.

3. A multiple-fuse holder as recited in claim 1, wherein the coupling parts have a strength that can maintain the pitch between adjacent two holder housings and yet can be broken by human force.

4. A multiple-fuse holder as recited in claim 1, wherein the coupling parts are provided at a plurality of points on the wall.

5. A multiple-fuse holder as recited in claim 1, wherein the coupling part is provided at a single point on the wall.

6. A multiple-fuse holder as recited in claim 1, wherein the holder housing group comprises twelve holder housings coupled together.

7. A multiple-fuse holder as recited in claim 1, wherein the insert is formed of a material of which heat resistance is superior to that of the holder housing.

8. A multiple-fuse holder as recited in claim 1, wherein the leg of the contact is forked into two branches.

9. A multiple-fuse holder as recited in claim 1, wherein a protrusion is formed in the leg of the contact.

10. A multiple-fuse holder as recited in claim 1, wherein the bottom of the holder housing is provided with two bosses in positions that are asymmetric to each other in relation to a line which runs, when seen from the bottom, between the front wall and the rear wall approximately in parallel with these walls.

11. A multiple-fuse holder as recited in claim 1, wherein the holder housing has the same color as that of the body of the fuse.

12. A multiple fuse holder into which a plurality of blade type fuses, with blade terminals protruding from the bodies thereof, are fittable, said multiple-fuse holder comprising a holder housing group including a plurality of holder housings, which each have a chamber for holding the blade terminals and a least a part of the body of a fuse inserted from above, wherein the chamber is formed with wide walls at the front and the rear and narrow walls an the right and the left, wherein the holder housings are arranged at a constant pitch and each pair of adjacent holder housings are coupled together by coupling parts, each of which is integrally formed on a part of a wall of the holder housings, and respectively two contacts provided for each holder housing, wherein each contact has an intermediate part fixed to the holder housing, a connecting part, at one end of the contact, extending into the chamber to fit with a blade terminal, and a leg, at another end of the contact, extending out of the holder housing to be soldered or press-fitted onto a printed circuit board, wherein the intermediate part of the contact is enveloped-cast in an insert and this insert is fitted into a space among the walls of the holder housing, and wherein the insert is formed of a material having a greater heat resistance than that of the holder housing.

13. A multiple-fuse holder as recited in claim 12, wherein the connecting part of the contact is formed into a fork shape, which can be expanded toward the front wall and the rear wall of the holder housing, and clearances between the connecting part and the front wall and the rear wall are set in such a way that they allow deformation of the connecting part while limiting its excessive deformation.

14. A multiple-fuse holder as recited in claim 12, wherein the coupling parts have a strength that can maintain the pitch between adjacent two holder housings and yet can be broke by human force.

15. A multiple-fuse holder as recited in claim 12, wherein the coupling parts are provided at a plurality of points on the wall.

16. A multiple-fuse holder as recited in claim 12, wherein the coupling part is provided at a single point on the wall.

17. A multiple-fuse holder as recited in claim 12, wherein the holder housing group comprises twelve holder housings coupled together.

18. A multiple-fuse holder as recited in claim 12, wherein two inserts are coupled together.

19. A multiple-fuse holder as recited in claim 12, wherein the leg of the contact is forked into two branches.

20. A multiple-fuse holder as recited in claim 12, wherein a protrusion is formed in the leg of the contact.

21. A multiple-fuse holder as recited in claim 12, wherein the bottom of the holder housing is provided with two bosses in positions that are asymmetric to each other in relation to fine which runs, when seen from the bottom, between the front wall and the rear wall approximately in parallel with these walls.

22. A multiple-fuse holder as recited in claim 12, wherein the holder housing has the same color as that of the body of the use.

* * * * *

UNITED STATES PATENT AND TRADEMARK OFFICE

CERTIFICATE OF CORRECTION

PATENT NO. : 6,666,723 B2
DATED : December 23, 2003
INVENTOR(S) : Fukumori et al.

It is certified that error appears in the above-identified patent and that said Letters Patent is hereby corrected as shown below:

Title page,
Item [75], Inventors, replace "Van Dessel Sonny" by -- Sonny VAN DESSEL --;

Column 5,
Line 39, after "bottom", replace "10b" by -- 110b --.

Column 9,
Line 56, after "coupling", replace "part" by -- parts --.

Column 11,
Line 28, after "housings", replace "re" by -- are --;
Line 33, before "housing,", replace "hold r" by -- holder --;
Line 34, after "contact,", replace "tending" by -- extending --;
Line 35, after "terminal,", replace "a d" by -- and --.

Column 12,
Line 60, before "which", replcae "fine" by -- a line --;
Line 65, after "the", replace "use." by -- fuse. --.

Signed and Sealed this

Twenty-third Day of March, 2004

JON W. DUDAS
*Acting Director of the United States Patent and Trademark Office*